US006332609B1

(12) United States Patent
Arakawa

(10) Patent No.: US 6,332,609 B1
(45) Date of Patent: Dec. 25, 2001

(54) FEED PAPER APPARATUS AND IMAGE FORMING APPARATUS

(75) Inventor: Masaya Arakawa, Hiratsuka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/506,726

(22) Filed: Feb. 18, 2000

(51) Int. Cl.[7] ..... B65H 1/26

(52) U.S. Cl. ..... 271/157; 271/15 B; 271/9.08; 414/795.8

(58) Field of Search ..... 271/157, 158, 271/159, 9.07, 9.08; 414/795.8

(56) References Cited

U.S. PATENT DOCUMENTS 4,801,135 * 1/1989 Povio ..... 271/157
5,102,112 * 4/1992 Takahashi ..... 271/157
5,971,387 * 10/1999 Kita ..... 271/157

* cited by examiner

*Primary Examiner*—H. Grant Skaggs
(74) *Attorney, Agent, or Firm*—Foley & Lardner

(57) ABSTRACT

This invention is made to prevent the user from re-setting paper by effecting a process for pushing a sheave of sheets of paper by a transferring guide towards the paper feeding side if setting of paper of a tandem type LCF is not correctly effected and when it is predicted that it is structurally safe based on information of an end guide switch and no-paper-on-the-wait-side switch.

Thus, useless time and labor of the user can be alleviated and the reliability as a device can be enhanced by effecting the transferring process which is structurally safe.

6 Claims, 9 Drawing Sheets

FEED PAPER APPARATUS AND IMAGE FORMING APPARATUS

BACKGROUND OF THE INVENTION

This invention relates to a feed paper apparatus for feeding paper and an image forming apparatus such as a copying machine having the feed paper apparatus.

In above the copying machine, various types of feed paper apparatuses are provided for paper feeding.

As one of large-capacity feed paper apparatuses, a large capacity feeder of tandem type (which is hereinafter referred to as a tandem type LCF) is provided.

It has two boxes (first and second boxes) for storing paper in the feed paper apparatus, and if paper does not exist in one of the boxes (first box), paper is moved from the other box (second box) to one of the boxes (first box) so that the paper feeding operation can be continued.

In this case, a series of processes from occurrence of no paper to the restart of paper feeding after the movement of paper from the other box (second box) to one of the boxes (first box) is defined as a transfer process.

As a result, it becomes possible to simultaneously supplement a large amount of paper and reduce the chances for interrupting the printing operation due to no paper or supplementing paper by the user.

Since only one box is provided in the unit in the conventional feed paper apparatus, there occurs no problem if paper is set according to the size thereof.

However, in the tandem type LCF, two boxes are provided in the unit. The two boxes are separated by a driving guide (which is hereinafter referred to as an end guide) and the user correctly sets paper into the two boxes according to the guide. If the user does not correctly set paper, a sensor attached to the end guide detects abnormality and warns the user that paper is not correctly set.

However, even if paper is correctly set, the user must withdraw the unit again by the warning and set paper if paper lies over the guide even a bit and it is detected as abnormality. As a result, it takes a lot of time and labor for the user.

If detection of abnormality by the guide is neglected and the tray-up or transfer process is effected in order to avoid this, damage or failure of the feed paper apparatus may occur and it is not an apparatus which is safe and highly reliable.

BRIEF SUMMARY OF THE INVENTION

An object of this invention is to provide a feed paper apparatus which is highly reliable and safe in structure and alleviates the labor of the user for setting paper again when paper is not correctly set in a large capacity feeder of tandem type and an image forming apparatus having the feed paper apparatus.

In order to attain the above object, this invention provides a feed paper apparatus characterized by comprising first and second receiving sections for receiving sheaves of sheets of paper of the same size; paper feeding means for feeding paper received in the first receiving section for each sheet; transferring means for transferring a sheave of sheets of paper received in the second receiving section to the first receiving section in a lump; first detecting means for detecting that paper received in the first receiving section is absent; first processing means for controlling the transferring means to transfer the sheave of sheets of paper received in the second receiving section to the first receiving section in a lump when the first detecting means detects that paper received in the first receiving section is absent; second detecting means for detecting that a sheave of sheets of paper is received while lying over the first, second receiving sections; and second processing means for controlling the transferring means to transfer a sheave of sheets of paper received while lying over the first, second receiving sections to the first receiving section in a lump when the second detecting means detects that the sheave of sheets of paper is received while lying over the first, second receiving sections.

This invention provides a feed paper apparatus characterized by comprising first and second receiving sections for receiving sheaves of sheets of paper of the same size; paper feeding means for feeding paper received in the first receiving section for each sheet; transferring means for transferring a sheave of sheets of paper received in the second receiving section to the first receiving section in a lump; first detecting means for detecting that paper received in the first receiving section is absent; first processing means for controlling the transferring means to transfer the sheave of sheets of paper received in the second receiving section to the first receiving section in a lump when the first detecting means detects that paper received in the first receiving section is absent; second detecting means disposed on an end portion opposite to the first receiving section, for detecting the presence/absence of a sheave of sheets of paper received in the second receiving section; third detecting means for detecting the presence/absence of a sheave of sheets of paper in an intermediate portion between the first and second receiving sections; and second processing means for controlling the transferring means to transfer a sheave of sheets of paper received in the intermediate portion between the first and second receiving sections to the first receiving section in a lump when the second detecting means detects the absence of a sheave of sheets of paper in the second receiving section and the third detecting means detects the presence of a sheave of sheets of paper in the intermediate portion between the first and second receiving sections.

In an image forming apparatus comprising supply means for supplying an image; a feed paper apparatus for feeding an image forming medium; and image forming means for forming an image supplied from the supply means on an image forming medium fed by the feed paper apparatus, this invention provides the image forming apparatus which is characterized in that the feed paper apparatus comprises first and second receiving sections for receiving sheaves of sheets of paper of the same size; paper feeding means for feeding paper received in the first receiving section for each sheet; transferring means for transferring a sheave of sheets of paper received in the second receiving section to the first receiving section in a lump; first detecting means for detecting that paper received in the first receiving section is absent; first processing means for controlling the transferring means to transfer the sheave of sheets of paper received in the second receiving section to the first receiving section in a lump when the first detecting means detects that paper received in the first receiving section is absent; second detecting means for detecting that a sheave of sheets of paper is received while lying over the first, second receiving sections; and second processing means for controlling the transferring means to transfer a sheave of sheets of paper received while lying over the first, second receiving sections to the first receiving section in a lump when the second detecting means detects that the sheave of sheets of paper is received while lying over the first, second receiving sections.

In an image forming apparatus comprising supply means for supplying an image; a feed paper apparatus for feeding an image forming medium; and image forming means for forming an image supplied from the supply means on an image forming medium fed by the feed paper apparatus, this invention provides the image forming apparatus which is characterized in that the feed paper apparatus comprises first and second receiving sections for receiving sheaves of sheets of paper of the same size; paper feeding means for feeding paper received in the first receiving section for each sheet; transferring means for transferring a sheave of sheets of paper received in the second receiving section to the first receiving section in a lump; first detecting means for detecting that paper received in the first receiving section is absent; first processing means for controlling the transferring means to transfer the sheave of sheets of paper received in the second receiving section to the first receiving section in a lump when the first detecting means detects that paper received in the first receiving section is absent; second detecting means disposed on an end portion opposite to the first receiving section, for detecting the presence/absence of a sheave of sheets of paper received in the second receiving section; third detecting means for detecting the presence/absence of a sheave of sheets of paper in an intermediate portion between the first and second receiving sections; and second processing means for controlling the transferring means to transfer a sheave of sheets of paper received in the intermediate portion between the first and second receiving sections to the first receiving section in a lump when the second detecting means detects the absence of a sheave of sheets of paper in the second receiving section and the third detecting means detects the presence of a sheave of sheets of paper in the intermediate portion between the first and second receiving sections.

DETAILED DESCRIPTION OF THE INVENTION

There will now be described an embodiment of this invention with reference to the accompanying drawings.

Figure 1:
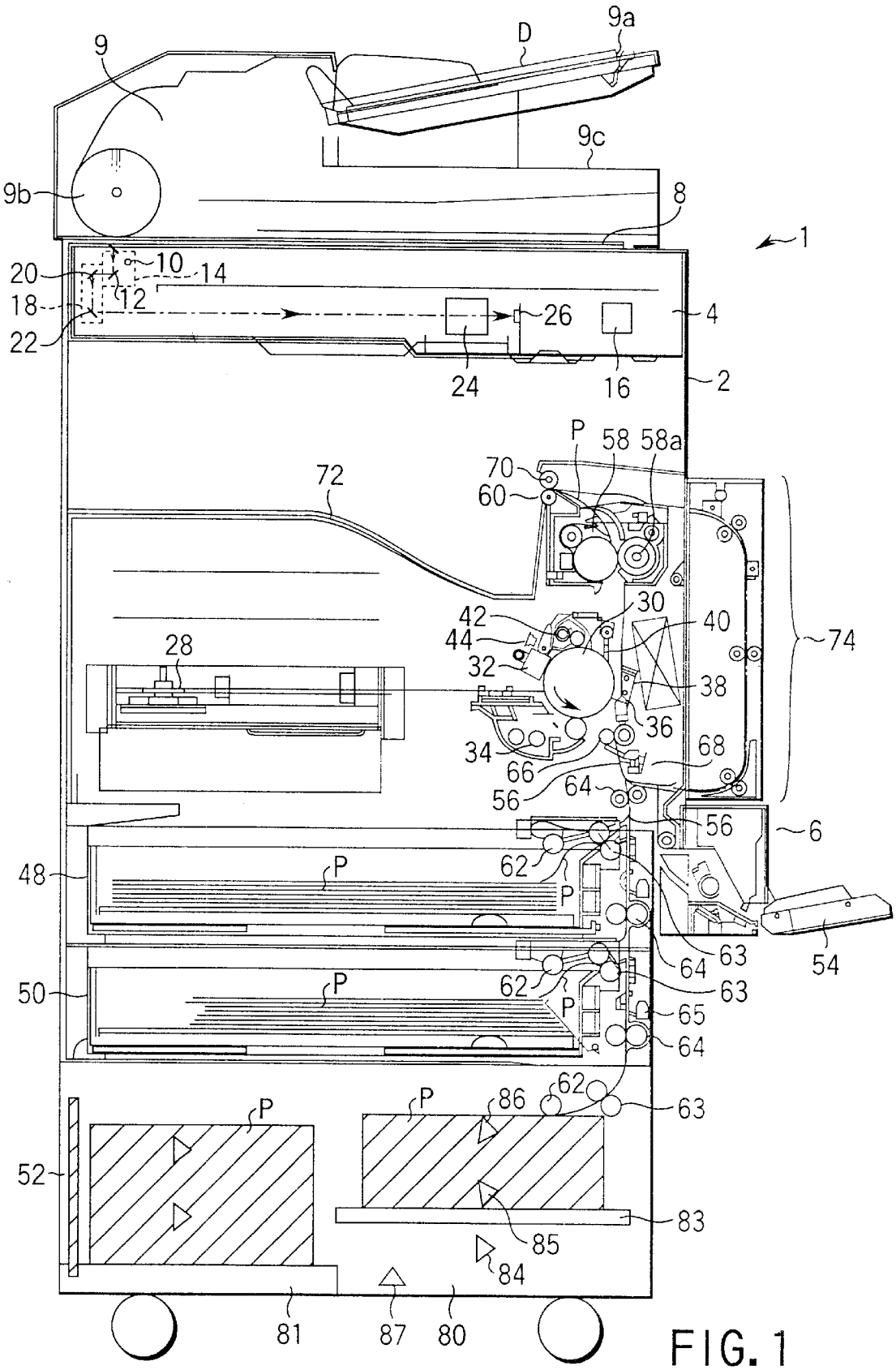
FIG. 1 is a cross sectional view showing the schematic construction of a digital copying machine.

FIG. 1 is a cross sectional view showing the schematic construction of a digital copying machine 1 as one example of an image forming apparatus of this invention.

As shown in FIG. 1, the digital copying machine 1 includes an apparatus main body 2 and a scanner section 4 as image reading means and a printer section 6 functioning as image forming means are provided in the apparatus main body 2.

On the upper surface of the apparatus main body 2, an original supporting table 8 formed of transparent glass on which a to-be-read object, that is, an original D is placed is provided. Further, on the upper surface of the apparatus main body 2, an automatic original feeder 9 (which is hereinafter referred to as an ADF) for automatically feeding the original D on to the original supporting table 8 is disposed.

A original D placed on an original tray 9*a* of the ADF 9 is carried by a carrying guide which is not shown in the drawing and discharged onto a paper discharging tray 9*c* via a platen roller 9*b*. Thus, while the original D is being carried by the platen roller 9*c*, it is exposed and scanned by an exposure lamp 10 of the scanner section 4 which will be described later to read an image of the original D.

The scanner section 4 disposed in the apparatus main body 2 includes the exposure lamp 10 constructed by a halogen lamp, for example, as a light source for illuminating the original D carried by the ADF 9 or the original D placed on the original supporting table 8, and a first mirror 12 for deflecting the reflected light from the original D to a preset direction, and the exposure lamp 10, first mirror 12 are mounted on a first carriage 14 disposed below the original supporting table 8.

The first carriage 14 is disposed to move in parallel to the original supporting table 8 and is reciprocally moved below the original supporting table 8 by a scanner motor (driving motor) 16 via a toothed belt which is not shown in the drawing or the like. The scanner motor 16 is constructed by a stepping motor or the like.

Further, below the original supporting table 8, a second carriage 18 movable in parallel to the original supporting table 8 is disposed. On the second carriage 18, second and third mirrors 20, 22 for sequentially deflecting the reflected light from the original D deflected by the first mirror 12 are mounted at right angles to each other. The second carriage 18 receives rotating force from the scanner motor 16 via a toothed belt or the like for driving the first carriage 14 to be driven with respect to the first carriage 14 and moved in parallel to the original supporting table 8 at half the speed of the first carriage 14.

Further, below the original supporting table 8, an image forming lens 24 for converging the reflected light from the third mirror 20 on the second carriage 18, and a CCD sensor (line sensor) 26 for receiving and photoelectrically converting the reflected light converged by the image forming lens 24 are disposed. The image forming lens 24 is disposed in a plane containing an optical axis of the light deflected by the third mirror 22 to be moved via a driving mechanism and forms an image of the reflected light with a desired magnification (in the main scanning direction) by its own movement. Then, the CCD sensor 26 photoelectrically converts the incident reflected light according to an image processing clock input from a main CPU which will be described later and outputs an electrical signal corresponding to the read original D. A magnification in the sub-scanning direction can be coped with by changing the feeding speed by the ADF 9 or the moving speed of the first carriage 14.

When the original D fed by the ADF 9 is read, the illuminating position by the exposure lamp 10 is fixed in a position shown in FIG. 1. Further, when the original D placed on the original supporting table 8 is read, the illuminating position by the exposure lamp 10 is moved from the left to the right along the original supporting table 8.

On the other hand, the printer section 6 has a laser exposure device 28 functioning as latent image forming means. An electrostatic latent image is formed on the peripheral surface of a photosensitive drum 30 by scanning the peripheral surface of the photo-sensitive drum 30 by use of laser light from the laser exposure device 28.

Further, the printer section 6 includes the rotatable photosensitive drum 30 as an image carrier disposed on the right portion of substantially the central portion of the apparatus main body 2 and the peripheral surface of the photosensitive drum 30 is exposed by the laser light from the laser exposure device 28 to form a desired electrostatic latent image. Along the peripheral surface of the photosensitive drum 30, an electric charger 32 for electrifying preset charges on the peripheral surface of the drum, a developing unit 34 for supplying toner as a developer to the electrostatic latent image formed on the peripheral surface of the photosensitive drum 30 to develop the image with a desired image density, a transferring charger 38 integrally having a separation charger 36 for separating the image forming medium fed from an LCF 52 or cassettes 48, 50 which will be described later, that is, copy paper P from the photosensitive drum 30, for transferring the toner image formed on the photosensitive drum 30 to the paper P, a separating claw 40 for separating the copy paper P from the peripheral surface of the photosensitive drum 30, a cleaning device 42 for cleaning toner left behind on the peripheral surface of the photosensitive drum 30, and a discharging unit 44 for discharging the peripheral surface of the photosensitive drum 30 are sequentially arranged.

In the lower portion in the apparatus main body 2, the upper-stage cassette 48, lower-stage cassette 50 and a large capacity feeder of tandem type (which is hereinafter referred to as a tandem type LCF) 52 as one of feed paper apparatuses of large capacity which can be withdrawn from the apparatus main body are disposed in a stacked form and sheets of copy paper P of different sizes are loaded in the cassettes 48, 50, LCF 52. A manually feeding tray 54 is provided on the side portion of the upper-stage cassette 48.

In the apparatus main body 2, a feeding path 56 extending from the cassettes 48, 50 or LCF 52 via a transferring section lying between the photosensitive drum 30 and the transferring charger 38 is formed and a fixing device 58 having a fixing lamp 58*a* is disposed at the end of the feeding path 56. Above the fixing device 58, a discharging port 60 is formed.

Near the upper-stage cassette 48, lower-stage cassette 50, LCF 52, paper feeding rollers 62 for taking out sheets of paper P for each sheet from the cassettes 48, 50 or LCF 52 and separation rollers 63 are respectively provided. Further, on the feeding path 56, a large number of paper feeding roller pairs 64 for feeding the copy paper P taken out by the paper feeding roller 62 and separation roller 63 via the feeding path 56 are provided. Near the respective paper feeding roller pairs 64, feeding sensors 65 for detecting the feeding states are provided.

On the upstream side of the photosensitive drum 30 in the feeding path 56, a resist roller pair 66 is provided. The resist roller pair 66 corrects the inclination of the copy paper P taken out, aligns the front end of the toner image on the photosensitive drum 30 with the front end of the copy paper P and feeds the copy paper P to the transferring section at the same speed as the moving speed of the peripheral surface of the photosensitive drum 30. On the front side of the resist roller pair 66, that is, on the paper feeding roller 64 side, a pre-aligning sensor 68 for detecting arrival of the copy paper P is disposed.

The copy paper P taken out from the cassette 48, 50 or LCF 52 for each sheet by the paper feeding roller 62 is fed to the resist roller pair 66 by the paper feeding roller pair 64. Then, the copy paper P is fed to the transferring section after the front end thereof is aligned by the resist roller pair 66.

In the transferring section, a developer image formed on the photosensitive drum 30, that is, a toner image is transferred on the paper P by the transferring charger 38. The copy paper P having the toner image transferred thereon is separated from the peripheral surface of the photosensitive drum 30 by the action of the separating charger 36 and separating claw 40 and fed to the fixing device 58 via a conveyor belt (not shown) constituting part of the feeding path 56. Then, after the developer image is melted and fixed on the copy paper P by the fixing device 58, the copy paper P is discharged to a discharging tray 72 in the apparatus main body 2 via the discharging port 60 by a paper discharging roller pair 70.

On the right side of the feeding path 56, an automatic double face device 74 for inverting the copy paper P which has passed through the fixing device 58 and feeding the same to the feeding path 56 again is disposed.

Further, on the upper portion on the front surface of the apparatus main body 2, an operation panel (which will be described later) for specifying various copying conditions such as a copy magnification and the start of copying or the like is disposed.

Figure 2:
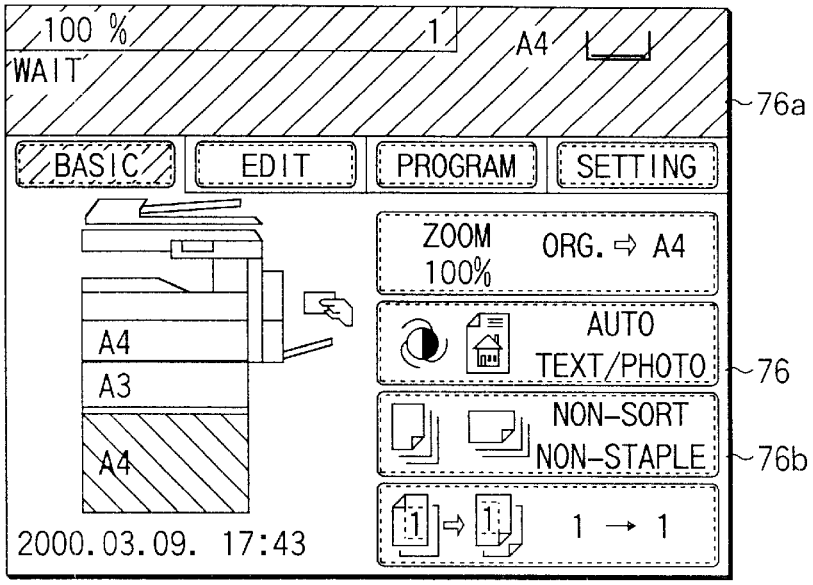
FIG. 2 is a view showing an example of display on a liquid crystal display section.

In the operation panel, as shown in FIG. 2, a liquid crystal display section (LCD) 76 containing touch keys for guiding the operation and making various specifications is provided.

As shown in FIG. 2, the liquid crystal display section 76 is constructed by an operation guide display section 76*a* for displaying an operation guide such as "WAIT" and a setting display section 76*b* for switching and displaying various setting contents. As shown in FIG. 2, the operation guide display section 76*a* displays a warning during the feeding control in the LCF 52 for the user, for example. As shown in FIG. 2, the setting display section 76*b* is a setting screen of basic function (BASIC) as an initial screen, for example, displays the selection state of the LCF 52, displays the setting state indicating that the zoom of 100%, the original size of A4, automatic selection of a photographic image and a text image, non-sort, non-staple, the ratio of the original to paper of 1:1, and displays an icon for specifying edition, program, setting change and the like.

Further, the setting display section 76*b* has setting screens of edition (EDIT), program (PROGRAM), setting (SETTINGS) and, for example, in the setting screen of program or setting, setting of the priority, cancellation of a job, display of a list of jobs, change or addition of setting of the priority can be made.

The digital copying machine 1 can be a device which is used independently or which is used as a network printer.

In this case, the digital copying machine 1 is so constructed as to be connected to personal computers (PC) (not shown), . . . or servers (not shown) via a local network (LAN) (not shown).

The internal construction of the LCF (large capacity feeder of tandem type) 52 is explained with reference to FIGS. 1, 3, 4.

Figure 3:
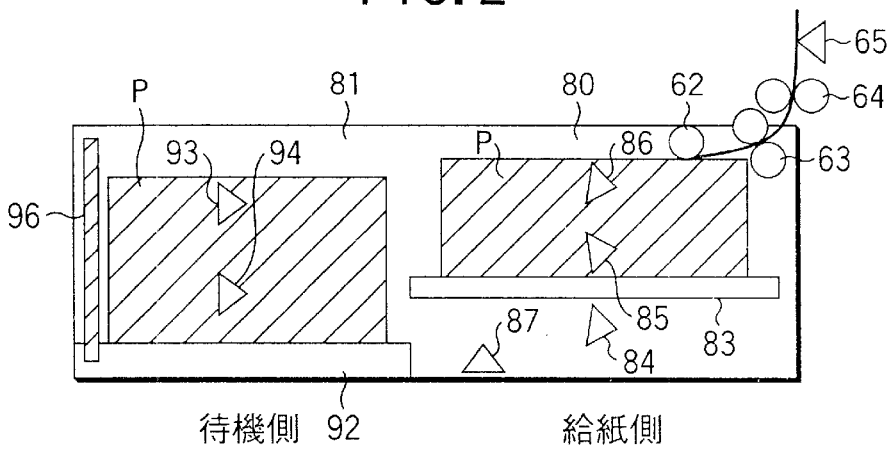
FIG. 3 is a side view showing the internal construction of an LCF.
Figure 4:
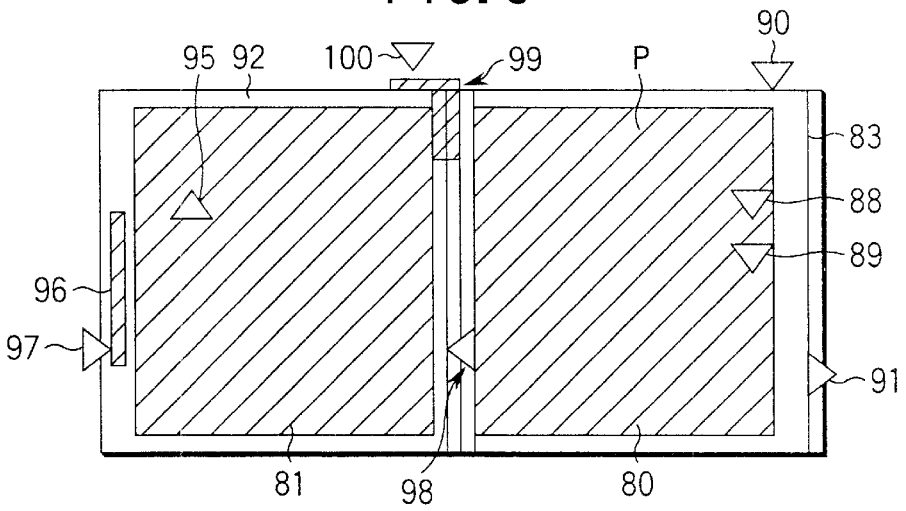
FIG. 4 is a top view showing the internal construction of the LCF.

FIG. 3 is a side view and FIG. 4 is a top view.

That is, the LCF 52 is constructed by two receiving sections including a first receiving section 80 on the paper feeding side and a second receiving section 81 on the wait side.

In the first receiving section 80, paper P to be fed to the main body side, that is, to the feeding path 56 is received. In the second receiving section 81, a sheave of sheets of paper P to be moved into the first receiving section 80 when paper P in the first receiving section 80 is used up is received. The second receiving section 81 has a transferring mechanism 82 for moving a sheave of sheets of paper P into the first receiving section 80 when paper P in the first receiving section 80 is used up.

In the first receiving section 80, a tray 83 on which received paper P is placed and which is vertically moved is provided. In the first receiving section 80, remaining amount switches 84, 85, 86 for detection of remaining amounts which are turned ON/OFF according to the movement of the tray 83 to output detection signals corresponding to 3-stage remaining amounts of paper P in the first receiving section 80 are provided. The remaining amount gradually becomes less in the order of detection by the remaining amount switch 84, detection by the remaining mount switch 85, detection by the remaining mount switch 86.

On the lower portion (bottom portion) of the first receiving section 80, a tray lower-limit switch 87 which is turned ON when the tray 83 reaches the lower limit is provided, and on the upper portion of the first receiving section 80, a tray upper-limit switch 88 which is turned ON when the tray 83 reaches the upper limit and a no-paper switch (no-paper-on-the-paper-feeding-side switch) 89 which is turned ON when no paper P exists on the tray 83 are provided.

Near the first receiving section 80, a cassette open switch 90 and LCF cover open switch 91 are provided.

In the second receiving section 81, a fixed tray 92 on which received paper P is placed is provided. In the second receiving section 81, remaining amount switches 93, 94 for detection of remaining amounts for outputting detection signals corresponding to 2-stage remaining amounts of paper P on the fixed tray 92 are provided. The remaining amount gradually becomes less in the order of detection by the remaining amount switch 93, detection by the remaining mount switch 94.

On the lower portion (bottom portion: fixed tray 92) of the second receiving section 81, a no-paper switch 87 (no-paper-on-the-wait-side switch) 95 which is turned ON when no paper P exists on the fixed tray 92 is provided. The no-paper switch 95 is provided on the left end side of FIGS. 3, 4 with respect to the center of the second receiving section 81.

In the second receiving section 81, a transferring guide 96 which is moved when paper P on the fixed tray 92 is moved in a sheave form to the tray 83 of the first receiving section 80 is provided. By moving the transferring guide 96 from the left end portion of FIGS. 3, 4 to the right, paper P on the fixed tray 92 is moved in a sheave form to the tray 83 of the first receiving section 80.

In the left end portion of the second receiving section 81 shown in FIGS. 3, 4, a guide start point switch 97 for detecting that the transferring guide 96 lies in the left end portion is provided.

In the right end portion of the second receiving section 81 shown in FIGS. 3, 4, a guide end point switch 98 for detecting that the transferring guide 96 lies in the right end portion of the second receiving section 81, that is, in an intermediate position between the first receiving section 80 and the second receiving section 81 is provided.

An end guide 99 is provided between the side portions of the intermediate position between the first receiving section 80 and the second receiving section 81, that is, between the paper feeding side and the wait side. Near the end guide 99, an end guide switch 100 which is turned ON/OFF according to the movement of the end guide 99 is provided.

The end guide 99 is like a partition for the first receiving section 80 and the second receiving section 81. Thus, since the end guide 99 is pushed if paper P is set between the first receiving section 80 and the second receiving section 81, the end guide switch 100 is turned ON, thereby making it possible to confirm that paper P is not correctly set.

The above various detection switches may be constructed by microswitches or optical detectors.

With the above-described construction, the vertically moving tray 83 is provided in the first receiving section 80 on the paper feeding side and continuous paper feeding can be attained by a specification from an SM-CPU 101 which will be described later while paper P is present on the tray 83. The presence/absence of paper P can be determined by detection from the no-paper-on-the-paper-feeding-side switch 89 when the tray 83 is moved up. The remaining amount switches 84, 85, 86 are mounted to recognize the remaining amount of paper P and the remaining amount of paper P can be recognized based on the height of the tray 83.

The transferring guide 96 is prepared on the left end in the second receiving section 81 on the wait side and it is possible to move the paper P on the wait side in a sheave form to the tray 83 on the paper feeding side by moving the transferring guide 96 to the right side by use of a motor (not shown) after confirming that the tray 83 is lowered to the lower limit when paper P on the paper feeding side is used up.

The position of the transferring guide 96 is controlled by the transferring guide start point switch 97 and transferring guide end point switch 98 and controlled to always lie at the left end in a process other than the transferring process. The presence/absence of paper P on the wait side can be recognized by the no-paper-on-the-wait-side switch 95 provided on the bottom surface on the wait side. Recognition of the remaining amount of paper P can be recognized according to the height of stacked paper P.

The end guide 99 is provided between the paper feeding side and the wait side. The end guide 99 is like a partition between the paper feeding side and the wait side, and since the end guide 99 is pushed if paper P is set in an intermediate position between the paper feeding side and the wait side, the pushing is recognized by the end guide switch 100, thereby making it possible to confirm that the paper P is not correctly set.

Figure 5:
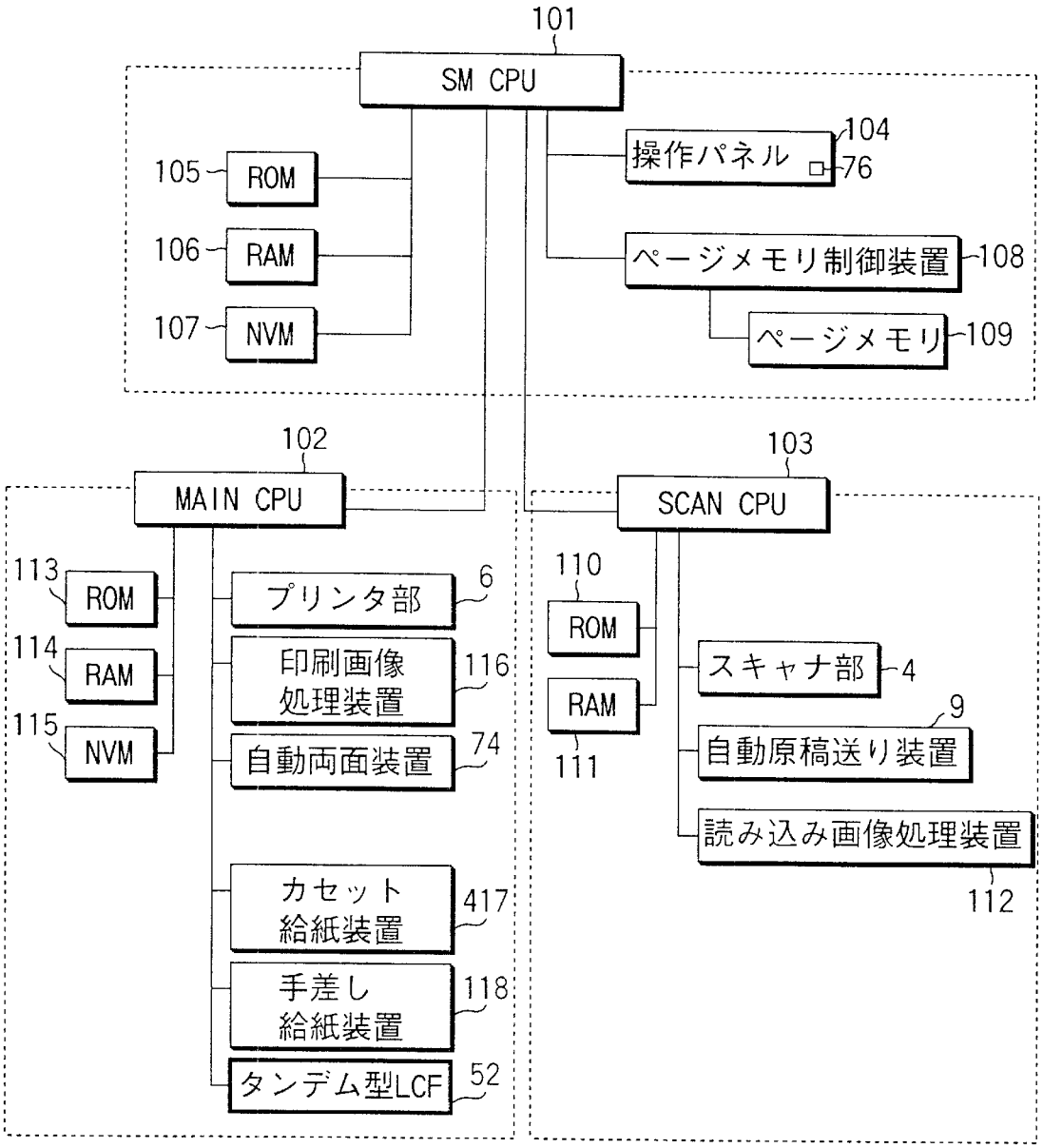
FIG. 5 is a diagram showing the internal construction of a control circuit of the digital copying machine.

The internal construction of a control circuit for the digital copying machine 1 is explained with reference to FIG. 5.

The control circuit for the digital copying machine 1 is constructed by three CPUs including an SM (System Main)-CPU 102 as a main control section, MAIN-CPU 102 for control of the printer section 6 and a SCAN-CPU 103 for control of the scanner section 4.

The SM-CPU 101 performs serial communication with the MAIN-CPU 102, the SM-CPU 101 issues an operation specification, and the MAIN-CPU 102 effects an operation based on the specification, and at the same time, returns the operation state status.

The SCAN-CPU 103 performs serial communication with the SM-CPU 101, and the SCAN-CPU 103 effects an operation based on a specification in response to the operation specification from the SM-CPU 101, and at the same time, returns the operation state status.

As a result, all of the operation states are returned as statuses to the SM-CPU 101, the SM-CPU 101 can always grasp the states and determines them and the input contents of an operation panel 104 to control the whole portion of the digital copying machine 1.

To the SM-CPU 101, a ROM 105, RAM 106, NVM 107, page memory control device 108 are connected.

The SM-CPU 101 controls the whole portion of the digital copying machine 1. The ROM 105 stores various control programs and control data. The RAM 106 temporarily stores data.

The NVM (nonvolatile random access memory: nonvolatile RAM) 107 is a nonvolatile memory backed up by a battery (not shown) for holding data on the NVM 107 when the power supply is turned OFF.

The page memory control section 108 stores and reads out image data into and from a page memory 109.

To the SCAN-CPU 104, a ROM 110, RAM 111, scanner section 4, ADF 9, read image processing device 112 are connected.

The SCAN-CPU 104 controls the scanner section 4, ADF 9, read image processing device 112 based on the SM-CPU 101. The ROM 110 stores various control programs and control data. The RAM 111 temporarily stores data.

The read image processing device 112 effects the process such as image correction of an original image read by the scanner section 4.

To the MAIN-CPU 102, a ROM 113, RAM 114, NVM 115, printer section 6, print image processing device 116, automatic double face device 74, cassette paper feeding device 117, manual paper feeding device 118, LCF 52 as a large capacity paper feeder are connected.

The MAIN-CPU 102 controls the printer section 6, print image processing device 116, automatic double face device 74, cassette paper feeding device 117, manual paper feeding device 118, LCF 52 based on the SM-CPU 101. The ROM 113 stores various control programs and control data. The RAM 114 temporarily stores data. The NVM 115 is a nonvolatile memory backed up by a battery (not shown).

The print image processing device 116 effects the shading correction, smoothing process, edge emphasis, enlarging/reducing process, gradation process and the like. The cassette paper feeding device 117 effects the paper feeding process by use of the upper-stage cassette 48, lower-stage cassette 50. The manual paper feeding device 118 effects the paper feeding process by use of the manually feeding tray 54.

Further, the page memory 109, read image processing device 112, print image processing device 116 are connected via an image data bus (not shown).

Figure 6:
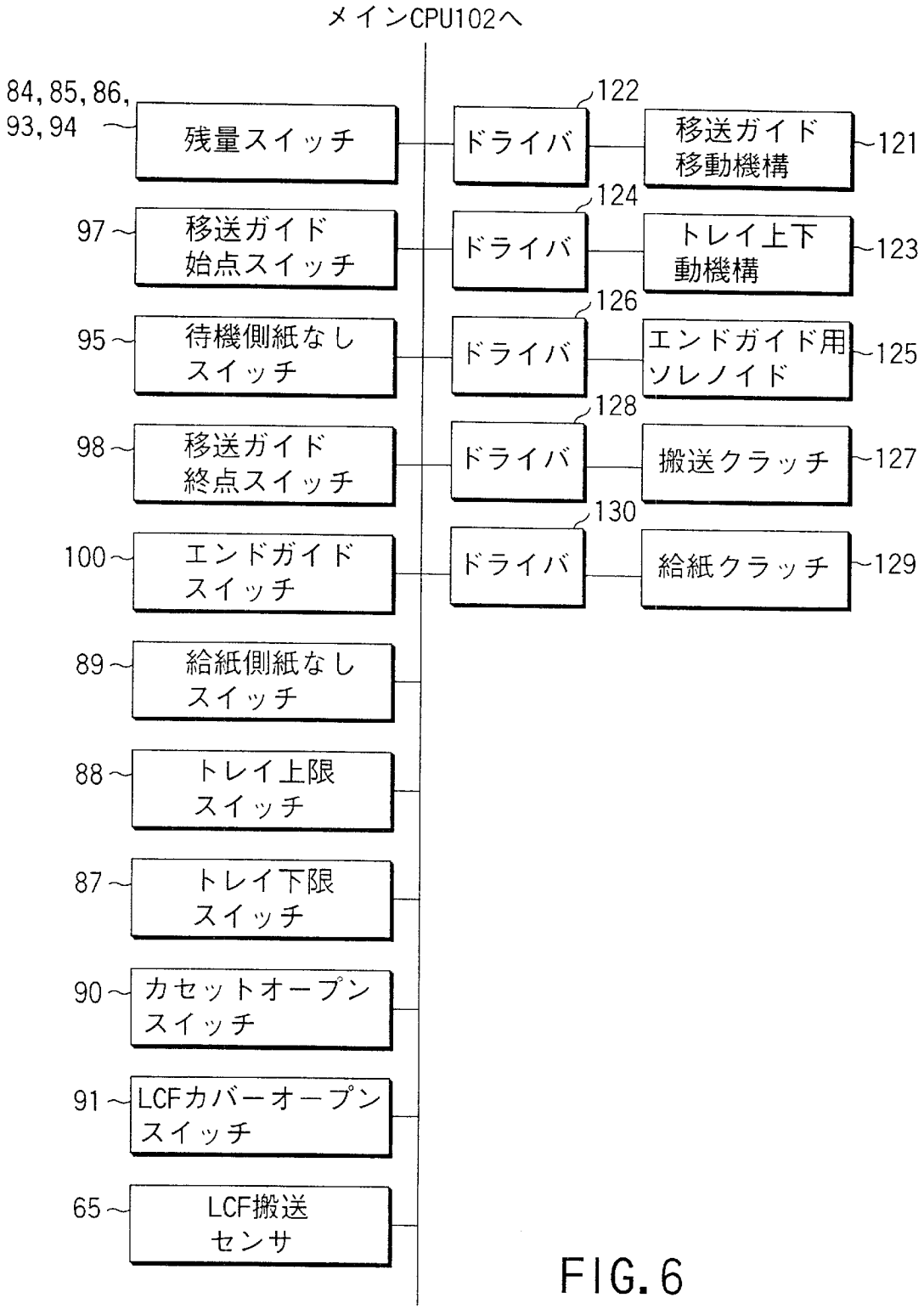
FIG. 6 is a diagram showing the internal circuit construction of the LCF.

The internal circuit construction of the LCF 52 is explained with reference to FIG. 6.

The LCF 52 is constructed by a driver 122 for driving a transferring guide moving mechanism 121 for moving the transferring guide 96, a driver 124 for driving a tray vertically moving mechanism 123 for vertically moving the tray 83, a driver 126 for driving (exciting) a solenoid 125 for end guide for pulling in the end guide 99, a driver 128 for driving a transfer clutch 127 for transmitting rotation of a motor which is not shown in the drawing to the transfer roller 64, and a driver 130 for driving a paper feeding clutch 129 for transmitting rotation of a motor which is not shown in the drawing to the paper feeding roller 62 and separation roller 63. The drivers 122, 124, 126, 128, 130 are connected to and driven and controlled by the MAIN-CPU 102.

The LCF 52 is constructed by the remaining amount switches 84, 85, 86, tray lower limit switch 87, tray upper limit switch 88, no-paper switch 89, cassette open switch 90, LCF cover open switch 91, remaining amount switches 93, 94, no-paper switch 95, guide start point switch 97, guide end point switch 98, end guide switch 100. Detection signals from the above switches are output to the SM-CPU 101 via the MAIN-CPU 102 and various confirming operations are effected.

Based on the above-described construction, the moving process (transfer control) of paper P from the wait side (second receiving section) 81 by the SM-CPU 101 when no paper P on the paper feeding side (first receiving section) 80 occurs in the LCF 52 is explained with reference to the flowchart shown in FIG. 7.

That is, if no paper occurs on the paper feeding side 80 during printing (paper feeding), whether or not paper P is present on the wait side 81 at this time is checked (ST1). If paper P does not exist, the tandem type LCF 52 determines that there is no paper and stops the printing process (ST2), or if paper P of the same size is present in another paper feeding cassette, it causes another paper feeding cassette to feed the paper according to the setting by the user and continues the printing process.

If paper P is present on the wait side 81 in the step 1, the transfer control is started. During this time, it interrupts the printing process or causes another paper feeding cassette to feed paper as described before.

First, the tray 83 on the paper feeding side 80 is lowered (ST3), and if it reaches the lower limit position, the tray 83 is stopped (ST4). If the stoppage is confirmed, the end guide 100 acting as a partition between the paper feeding side 80 and the wait side 81 is opened (ST5) and a state in which the partition is removed is set.

If it is confirmed that the end guide 100 is opened, a sheave of sheets of paper P which lies on the wait side 81 is pushed onto the tray 83 on the paper feeding side 80 by the transferring guide 96 (ST6). When the transferring guide 96 reaches a position of the end of pushing, the process for returning the transferring guide 96 to its original position is started, and when it returns to the original position, it is stopped (ST7). When the transferring guide 96 starts to be returned, the end guide 99 is closed (ST8) and the tray 83 is raised (ST9) after confirming that the paper P is correctly transferred and the partition (end guide 99) returns to the correct position. If the tray is raised and a state in which paper P is present on the paper feeding side 80 is set (ST10), the printing process which is interrupted is automatically restarted.

In a period between the steps 3 and 10, the SM-CPU 101 causes the liquid crystal display section 76 to display a warning as shown in FIG. 2 during the transfer control for the user. At this time, if the transfer process is started, it urges the user to pay attention to the warning by displaying "WAIT".

When the transfer process is terminated, a message of "WAIT" or the like is released and a normal copying operation is effected.

As described above, since a series of operations will occur if the transferring process is effected, it takes time. During this time, since the printing operation is interrupted, for example, it is supposed that the user waiting for termination of the printing operation has an unnatural feeling that something has happened because the printing operation is interrupted although a jam does not occur and he will open the cover to provide a possibility of being caught in.

As a result, a warning is issued to make it clear for the user that the process is normal although the printing operation is interrupted.

Thus, it is possible for the user to recognize that it is necessary to take time for the process of the LCF and the unnatural feeling of the user can be alleviated.

Figure 8:
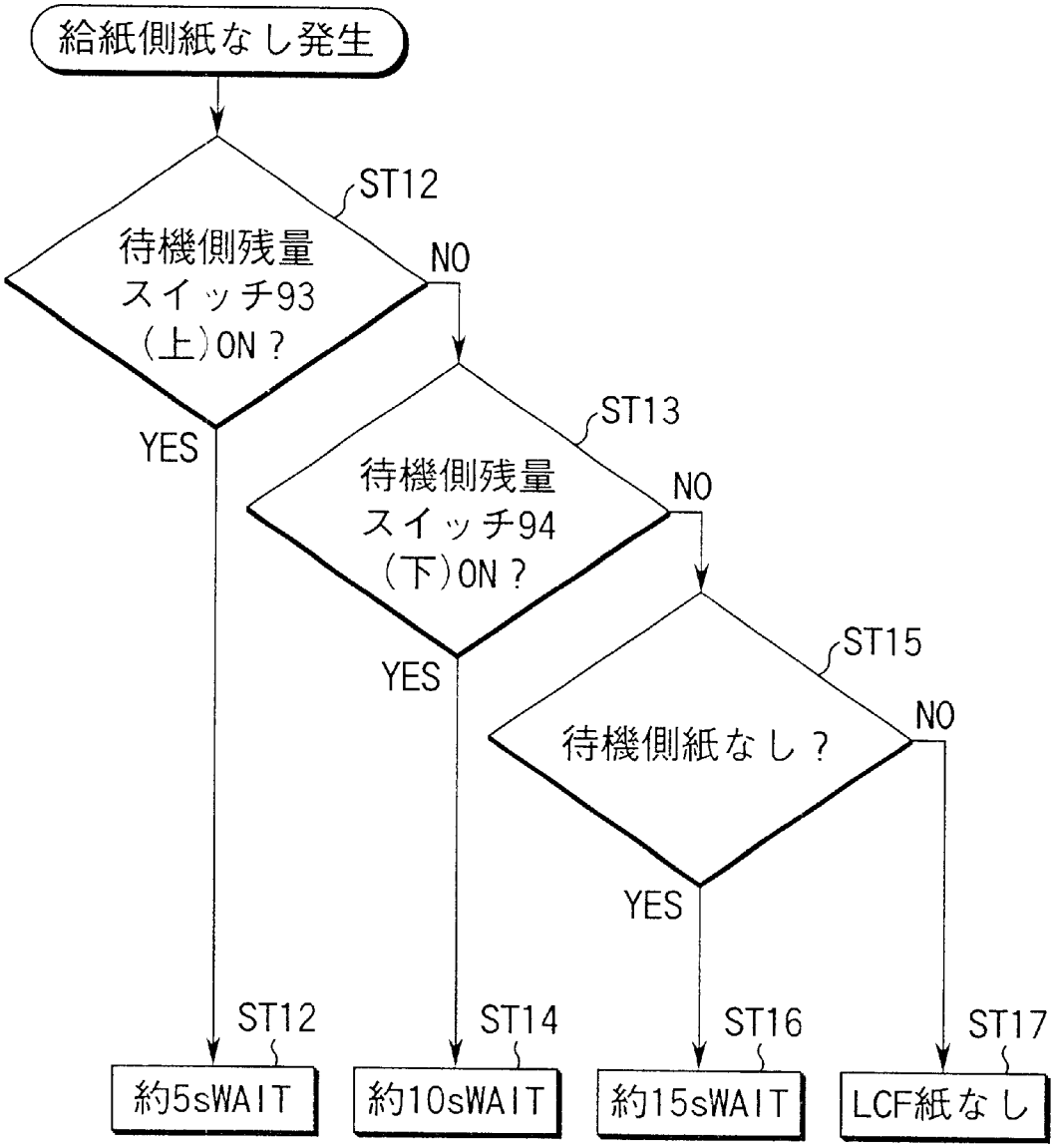
FIG. 8 is a flowchart for illustrating an example of a control operation for displaying time for interruption when a warning is issued during the transferring process.

An example of the control operation of the SM-CPU 101 for displaying time for interruption when the warning is issued during the transferring process described above is explained with reference to the flowchart shown in FIG. 8.

The SM-CPU 101 can recognize the remaining amount of paper P on the wait side 61 based on detection signals from the remaining amount switches 93, 94, no-paper switch 95 provided on the wait side 61 of the LCF 52 and indicate to the user how long it takes until the printing operation is restarted based on the result of recognition.

Figure 7:
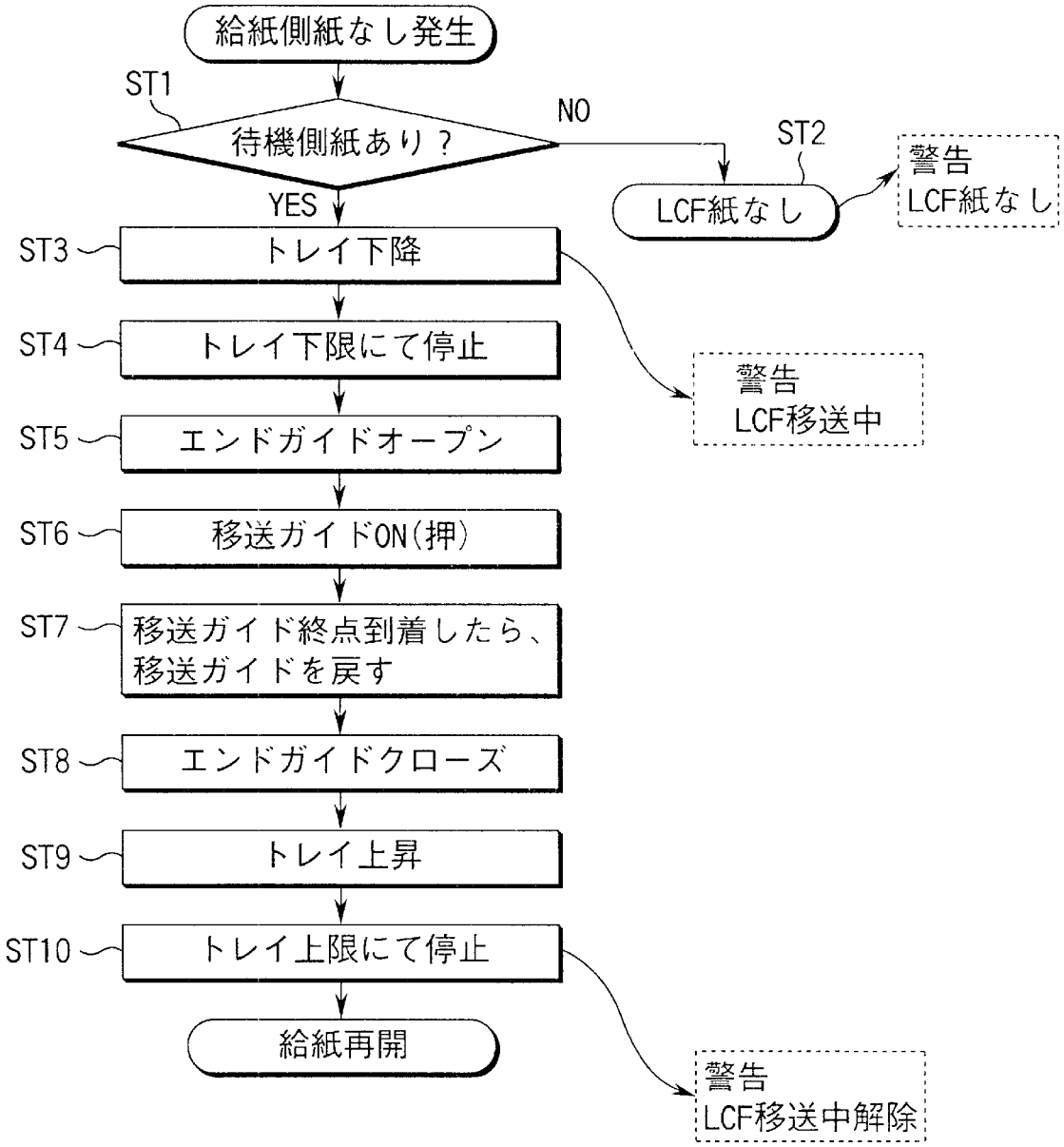
FIG. 7 is a flowchart for illustrating a paper movement process from the wait position when the absence of paper on the paper feeding side of the LCF occurs.

When no paper P on the paper feeding side 80 in FIG. 7 occurs, it can recognize the remaining amount of paper P on the wait side 61 based on the detection signals from the remaining amount switches 93, 94, no-paper switch 95 on the wait side 81 together with checking of the presence/absence of paper on the wait side 81, recognize time based on the recognized remaining amount, and issue a warning together with the time to the user.

For example, when the remaining amount switch 93 is set ON (ST11), the SM-CPU 101 determines that the remaining amount of paper P on the wait side 81 is large, determines that the wait time is 5 seconds (ST12) and displays the result of determination on the liquid crystal display section 76.

Further, when the remaining amount switch 93 is set OFF (ST11) and the remaining amount switch 94 is set ON (ST13), the SM-CPU 101 determines that the remaining amount of paper P on the wait side 81 is almost half, determines that the wait time is 10 seconds (ST14) and displays the result of determination on the liquid crystal display section 76.

Further, when the remaining amount switches 93, 94 are set OFF (ST11, 13) and the no-paper switch 95 is set ON (ST15), the SM-CPU 101 determines that the remaining amount of paper P on the wait side 81 is small, determines that the wait time is 15 seconds (ST16) and displays the result of determination on the liquid crystal display section 76.

Further, when the remaining amount switches 93, 94, no-paper switch 95 are set OFF (ST11, 13, 15), the SM-CPU 101 determines that no paper P is present on the wait side 81, determines that no paper P of the LCF 52 is present (ST17) and displays the result of determination on the liquid crystal display section 76.

Figure 9:
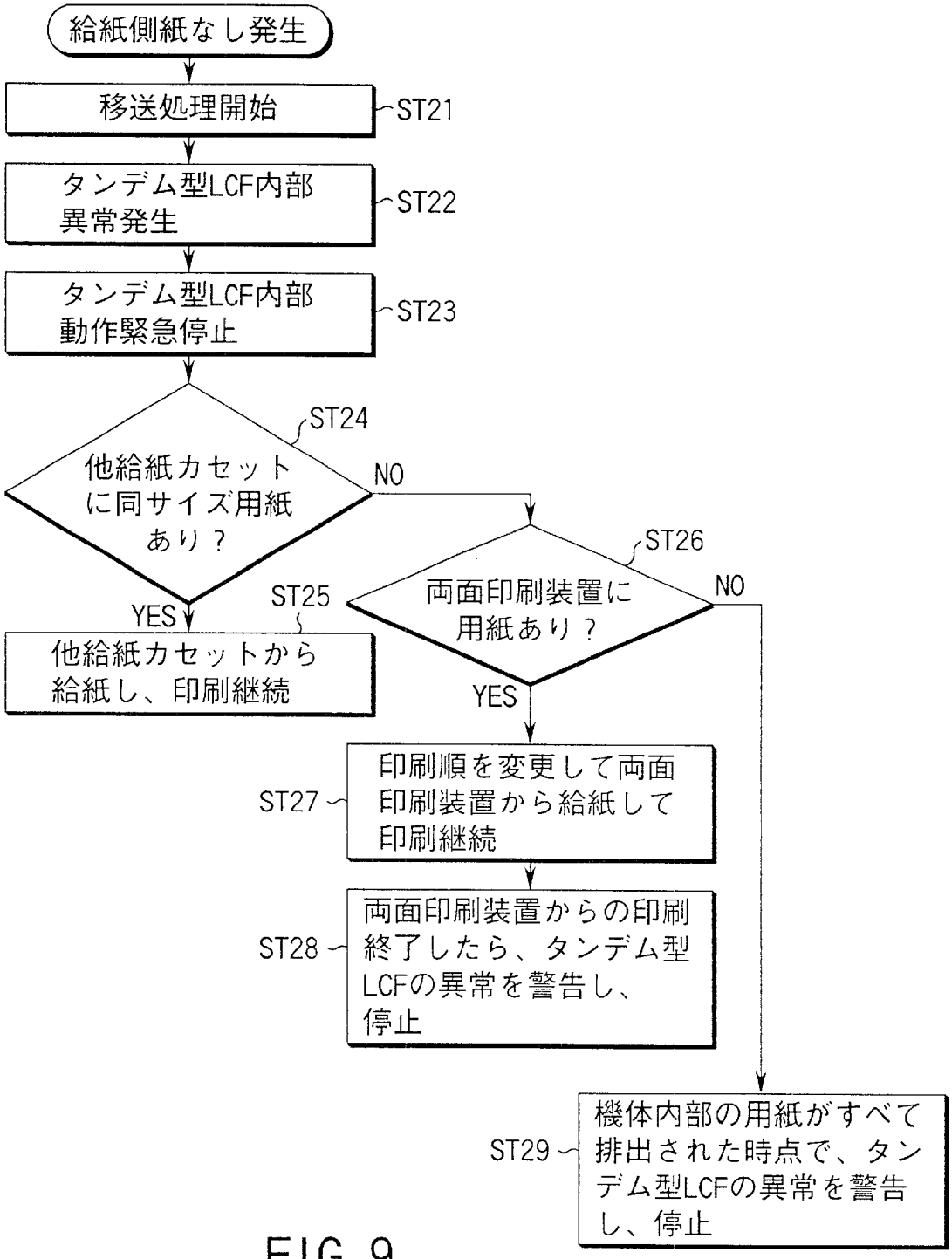
FIG. 9 is a flowchart for illustrating an example of a control operation when an abnormal state occurs during the transferring process.

Next, an example of the control operation by the SM-CPU 101 when abnormality occurs during the above-described transfer controlling process is explained with reference to the flowchart shown in FIG. 9.

If paper P is caught in the internal portion of the tandem type LCF 52 during the transfer controlling process or a condition that the transfer process cannot be normally terminated occurs due to disorder of a motor or the like, it is quickly stopped for safety in a hardware manner, but it is supposed that paper P which is still transferred is present in a device body other than the tandem type LCF 52.

In the case of single-face printing, no problem occurs if a normal transferring process is effected, but if the double face printing device 74 is used, paper is fed from the tandem type LCF 52 in the normal printing order, but since abnormality has occurred, it is necessary to change the order of outputting images and start the printing operation in order to start the printing operation by the double face printing device 74. Thus, paper P which can be fed even at the time of occurrence of abnormality is fed in the device body.

That is, if no paper occurs on the paper feeding side 80 during printing (paper feeding), the SM-CPU 101 starts the transferring process described above (ST21). After this, the SM-CPU 101 determines occurrence of abnormality in the internal portion of the LCF 52 (ST22) when the no-paper switch 95, end guide switch 100 are set ON and rapidly stops the transferring process in the internal portion of the LCF 52 (ST23).

In this state, the SM-CPU 101 checks whether or not paper P of the same size is received in a different paper feeding cassette (ST24). As the result, if paper P of the same size is received in the different paper feeding cassette, the SM-CPU 101 feeds paper from the different cassette and continues the printing operation (ST25). As the result of the step ST24, the SM-CPU 101 determines whether or not paper P is received in the double face printing device 74 (ST26).

As a result, if the SM-CPU 101 determines that paper P is received in the double face printing device 74, it changes the printing order, feeds paper from the double face printing device 74 and continues the printing operation (ST27). After this, when the printing from the double face printing device 74 is terminated, the SM-CPU 101 warns the abnormality by use of the liquid crystal display section 76 and terminates the process (ST28).

Further, as the result of the step ST26, if the SM-CPU 101 determines that no paper P is received in the double face printing device 74, it warns the abnormality by use of the liquid crystal display section 76 and terminates the process (ST29) when all of the sheets of paper P in the internal portion of the device body are discharged.

As described above, when abnormality occurs during the transferring process, it prevents the user from effecting the removing process of paper in the double face printing device 74 by issuing a warning that the LCF 52 is abnormal after the printing order is changed and paper P in the double face printing device 74 is printed.

Figure 10:
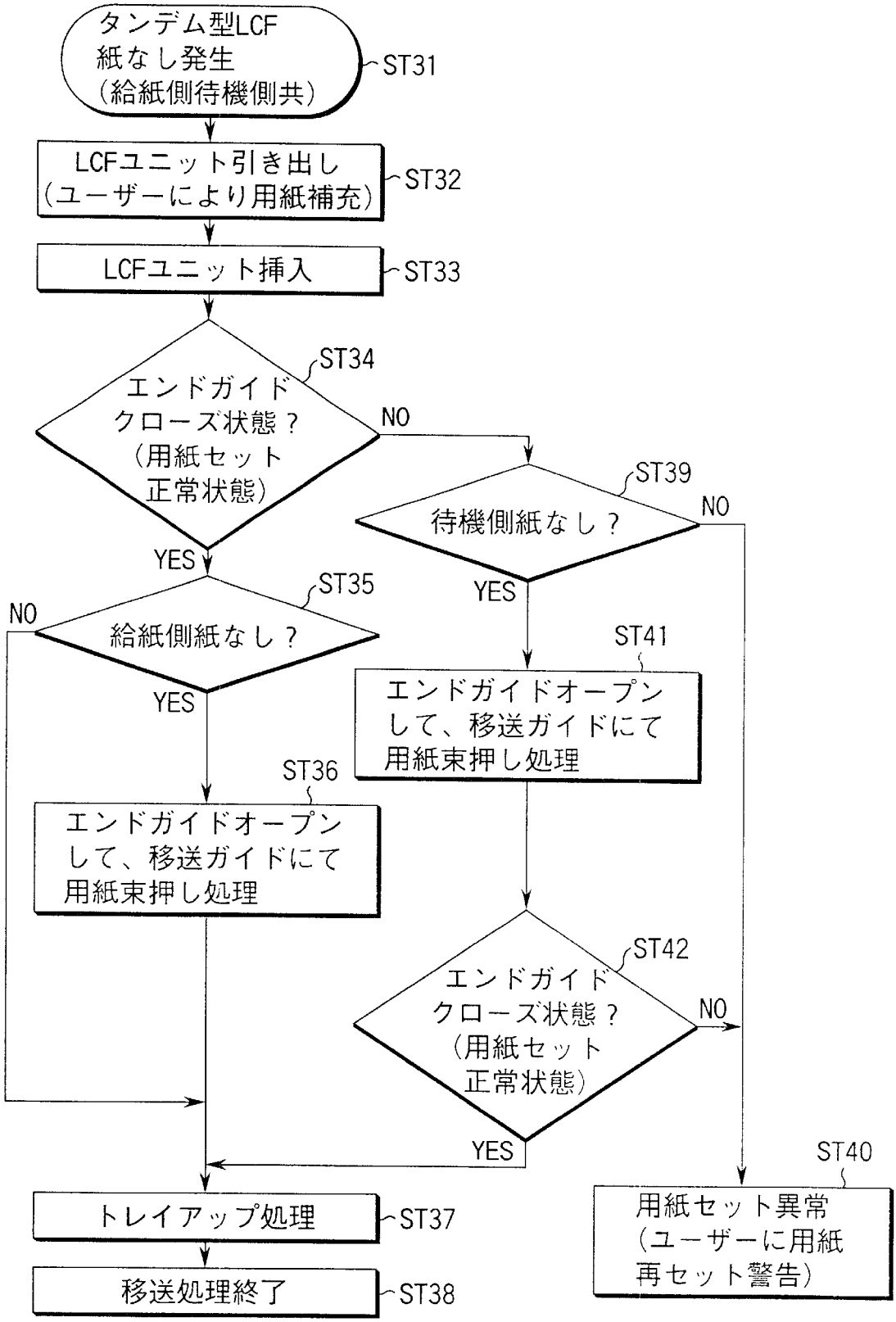
FIG. 10 is a flowchart for illustrating an example of a control operation when paper is not correctly set in the LCF.

Next, an example of the control operation by the SM-CPU 101 when paper P is not correctly set in the LCF 52 is explained with reference to the flowchart shown in FIG. 10.

That is, if paper P is present on neither the paper feeding side 80 nor the wait side 81 in the LCF 52, the SM-CPU 101 displays no paper of the LCF 52 by use of the liquid crystal display section 76 (ST31).

By the display, the user withdraws the LCF unit and supplements paper P (ST32). Since the paper feeding side 80 and the wait side 81 are partitioned by the end guide 99, the user arbitrarily supplements paper P according to the same. It is assumed that the size is A4 (LT).

At this time, if paper P is set to lie over the paper feeding side 80 and wait side 81 in such a manner as to push (open) the end guide 99, conventionally, the open state of the end guide 99 is detected, it is recognized that the paper P is not correctly set, and a warning that the paper P is not correctly set is issued to the user so as to cause the user to re-set the paper P. If the tray is raised and the transferring process is effected without making the above determination, it is supposed that a possibility that paper P is caught by a gap in the machine may occur, thereby causing a possibility that the machine is broken.

In this invention, the process for urging the user to re-set in the prior art may not be effected to make it unnecessary for the user to re-set if it is recognized that it is safe in mechanism.

That is, paper P is supplemented and the user inserts the LCF unit. As a result, the SM-CPU 101 determines insertion of the LCF unit (ST33) and determines whether or not paper P is correctly set (ST34) by recognizing the open/closed state of the end guide 99 based on the ON/OFF state of the end guide switch 100.

As a result, if the end guide 99 is closed, the SM-CPU 101 determines that the paper P is correctly set, raises the tray like the conventional case, recognizes the presence of paper P on the paper feeding side 80 (ST35), and if no paper P is present on the paper feeding side 80, it effects the process for transferring from the wait side (ST36).

Further, after the transferring process, or when it is recognized in the step ST35 that paper P is present on the paper feeding side 80, the SM-CPU 101 effects the tray-up process and then terminates the process (ST37, 38).

Figure 11:
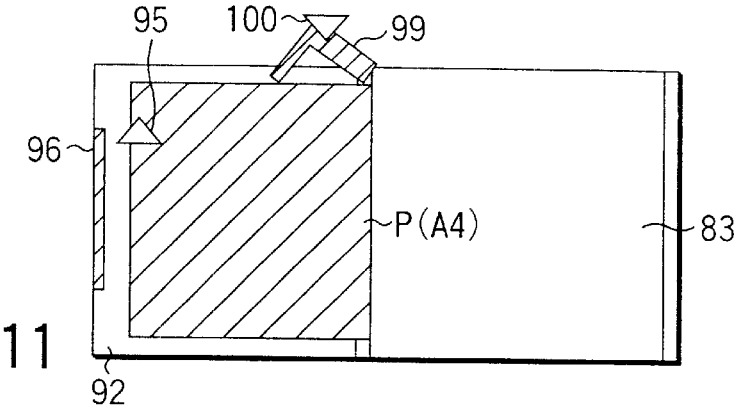
FIGS. 11, 12, 13 are views showing examples of states of paper in a case where it is supposed that the transferring process cannot be effected when the abnormal state of paper set in the LCF occurs.
Figure 12:
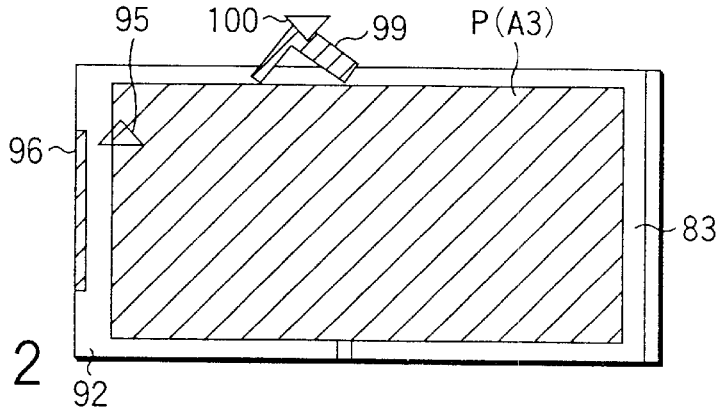
Figure 13:
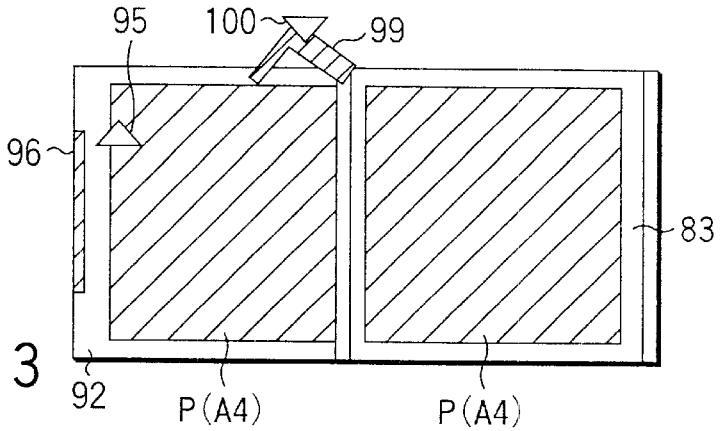

Further, as the result of the step 34, if the end guide 99 is not closed, the SM-CPU 101 determines that paper P is not correctly set and determines the receiving state of paper P based on the ON/OFF state of the no-paper-on-the-wait-side switch 95 of the wait side 81 (ST39). For example, if the end guide switch 100 is set ON and the no-paper-on-the-wait-side switch 95 is also set ON, it is assumed that paper P to be inserted into the wait side 81 is slightly shifted towards the right direction and lies over the end guide 99. This is the state of FIG. 11. Further, it can also be predicted that A3 (LT) with the same width has been inserted. This is the state of FIG. 12. it is also predicted that sheets of paper are set on both of the paper feeding side and wait side and either one is slightly and accidentally shifted to lie over the end guide. This is the state of FIG. 13.

In such a case, if an attempt is made to push a sheave of sheets of paper P by use of the transferring guide 52, it is assumed that it is obstructed by the paper P of A3 size or sheets of paper P on the paper feeding side 80 and wait side 81 collide against each other so as to make it impossible for the transferring guide 52 to push it and break the motor or the like, and therefore, the SM-CPU 101 issues a warning to the user that setting of the paper P is abnormal like the conventional case in this case (ST40).

As described above, if the end guide 99 is open (it is predicted that paper P is placed to lie over them), the ON/OFF state of the no-paper-on-the-wait-side switch 95 on the bottom surface of the wait side 81 is checked. As shown in the drawing as viewed from the above as in FIG. 4, if it is assumed that the no-paper-on-the-wait-side switch 95 is set in a position near the left end of the wait side 81, it issues a warning to the user that setting of the paper P is abnormal like the conventional case when it is recognized that paper is present on the wait side 81.

Further, if the end guide 99 is open (it is predicted that paper P is placed to lie over them) and it is confirmed that no paper is present by the OFF state of the no-paper-on-the-wait-side switch 95, it is assumed that the user tries to set paper P on the paper feeding side 80 and the paper is slightly shifted to the left direction and lies over the end guide 99.

Figure 14:
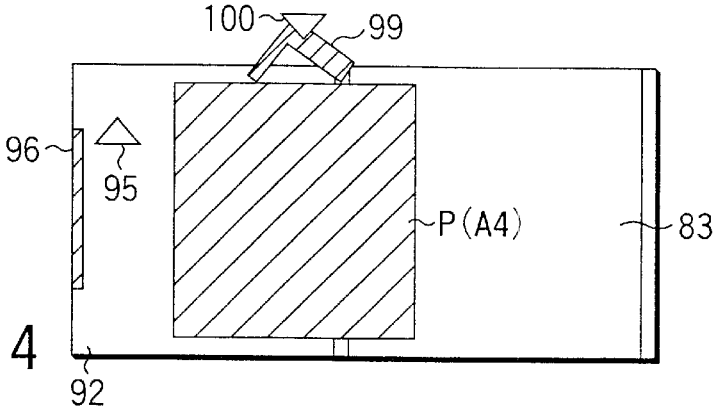
FIG. 14 is a view showing an example of a state of paper in a case where it is supposed that the transferring process can be effected when the abnormal state of paper set in the LCF occurs.
Figure 1:
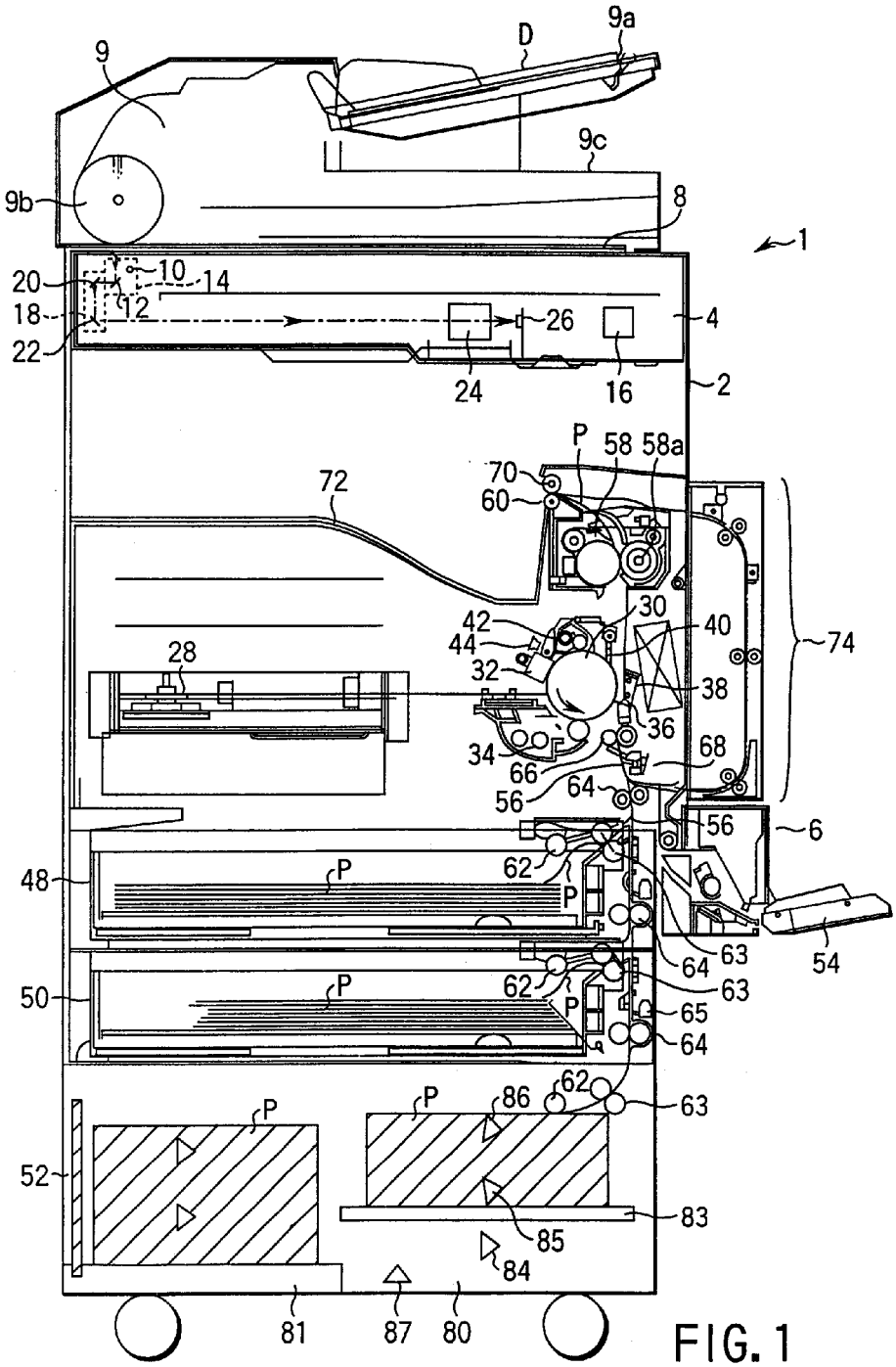
Figure 2:
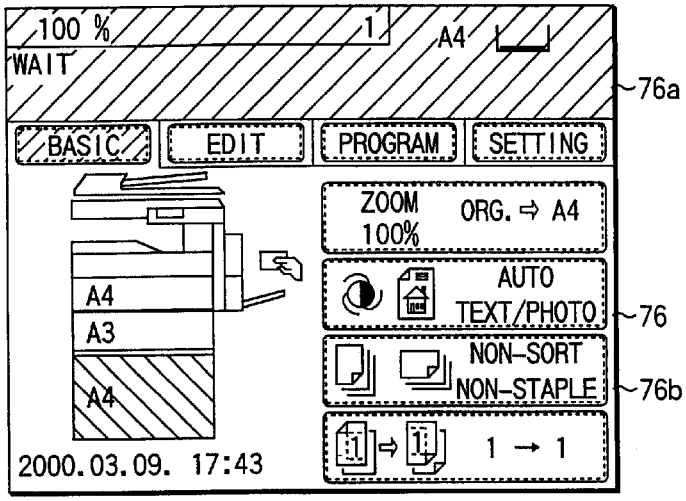
Figure 3:
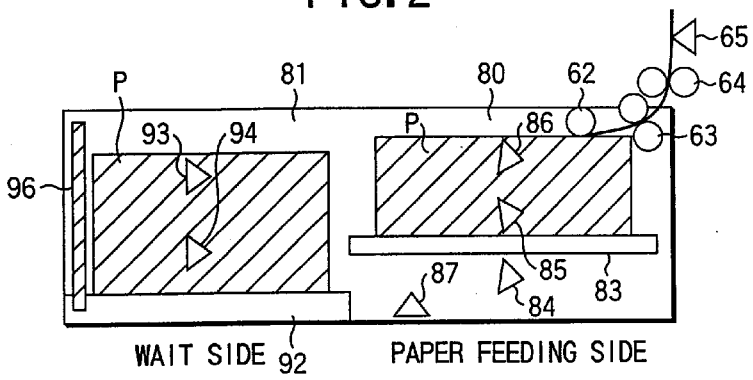
Figure 4:
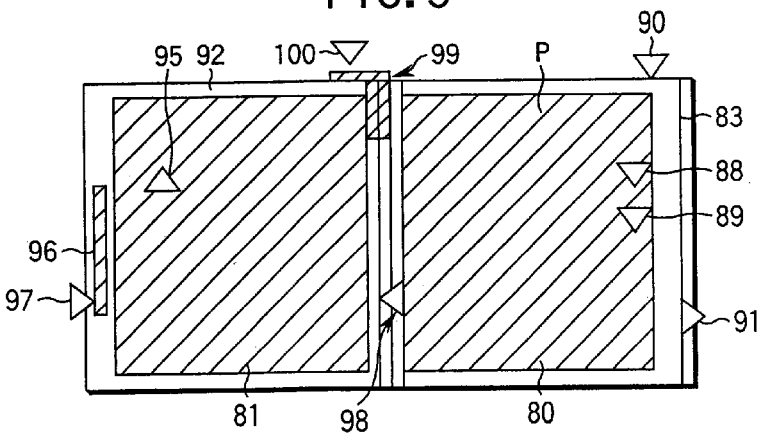
Figure 5:
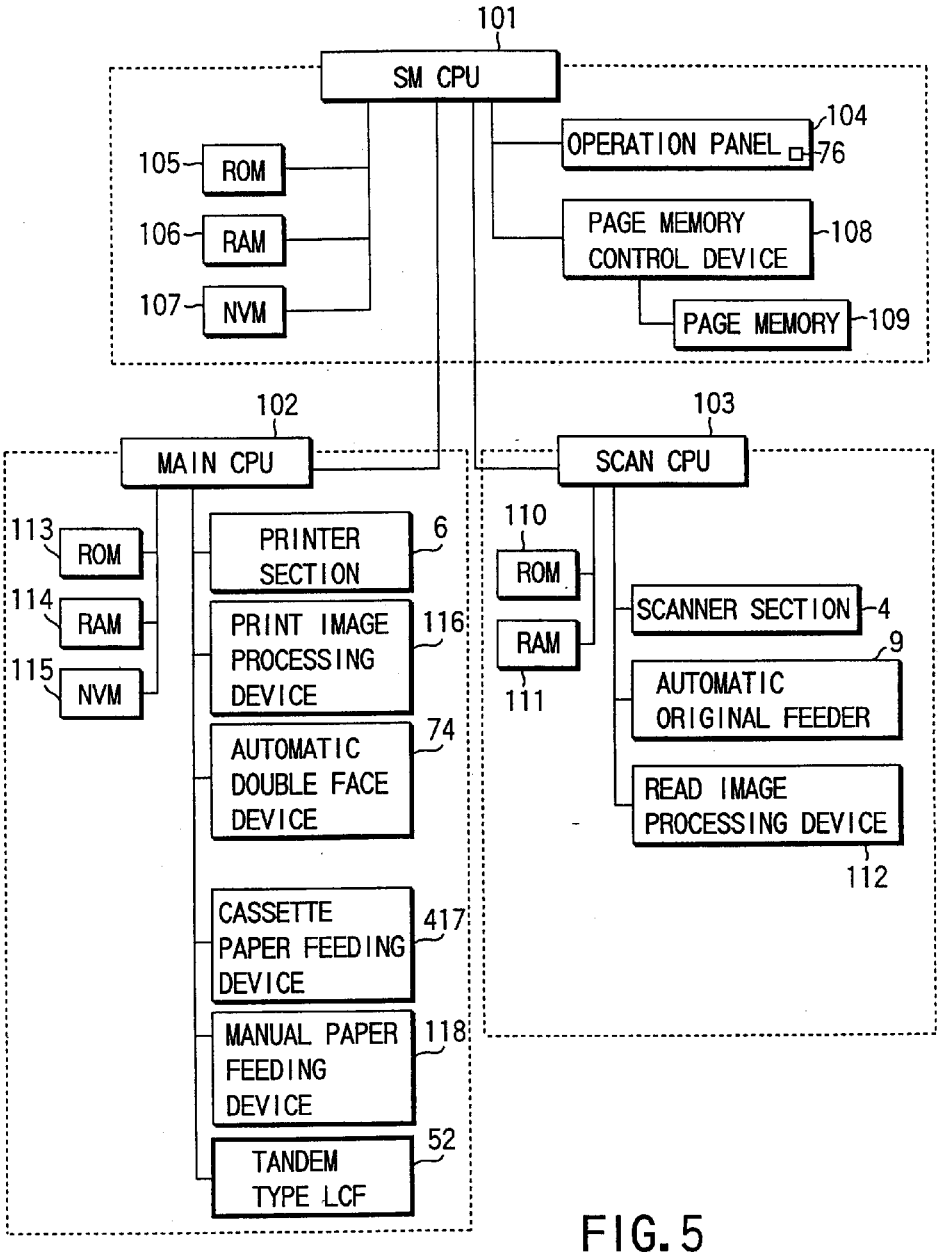
Figure 6:
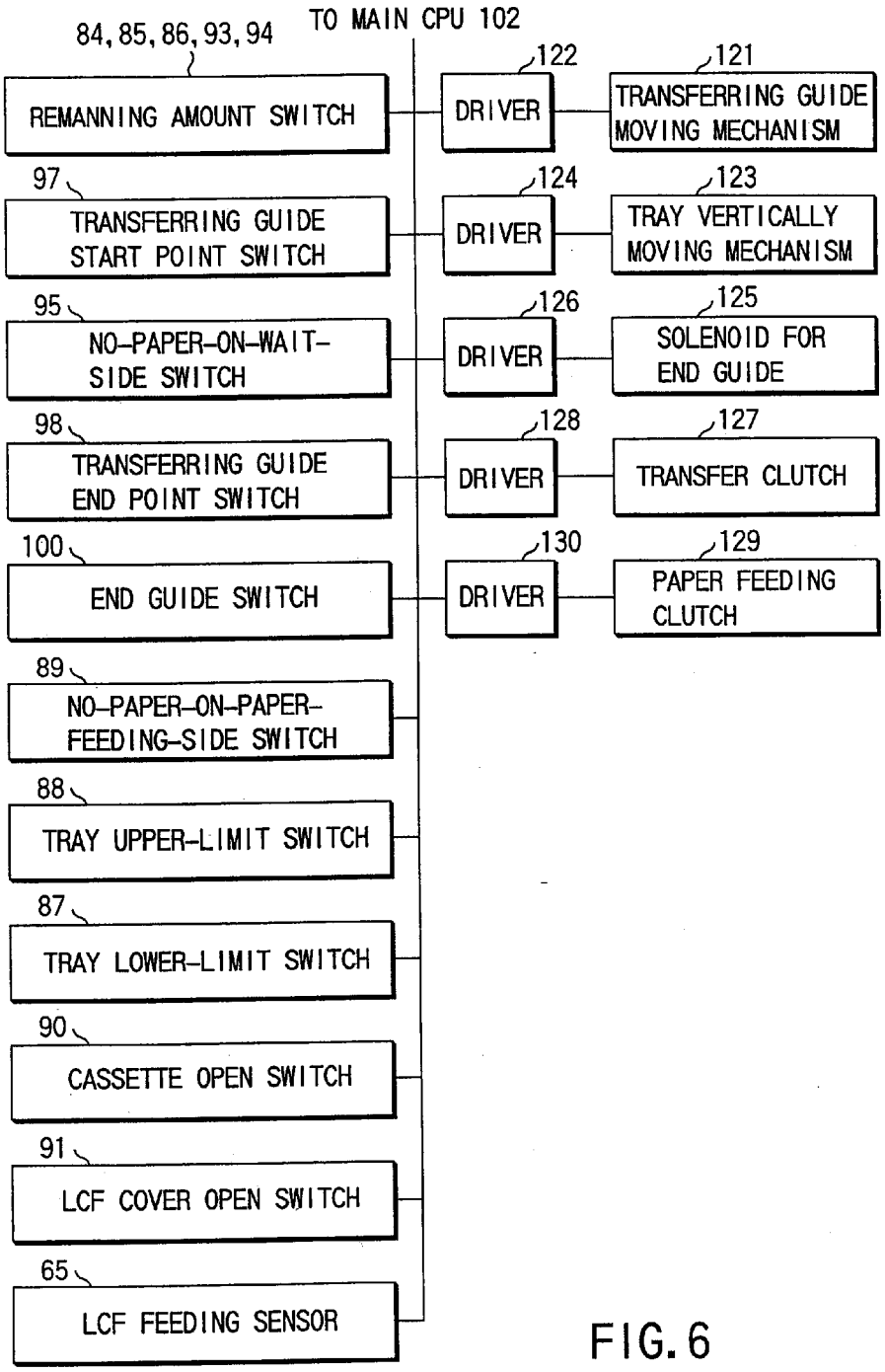
Figure 7:
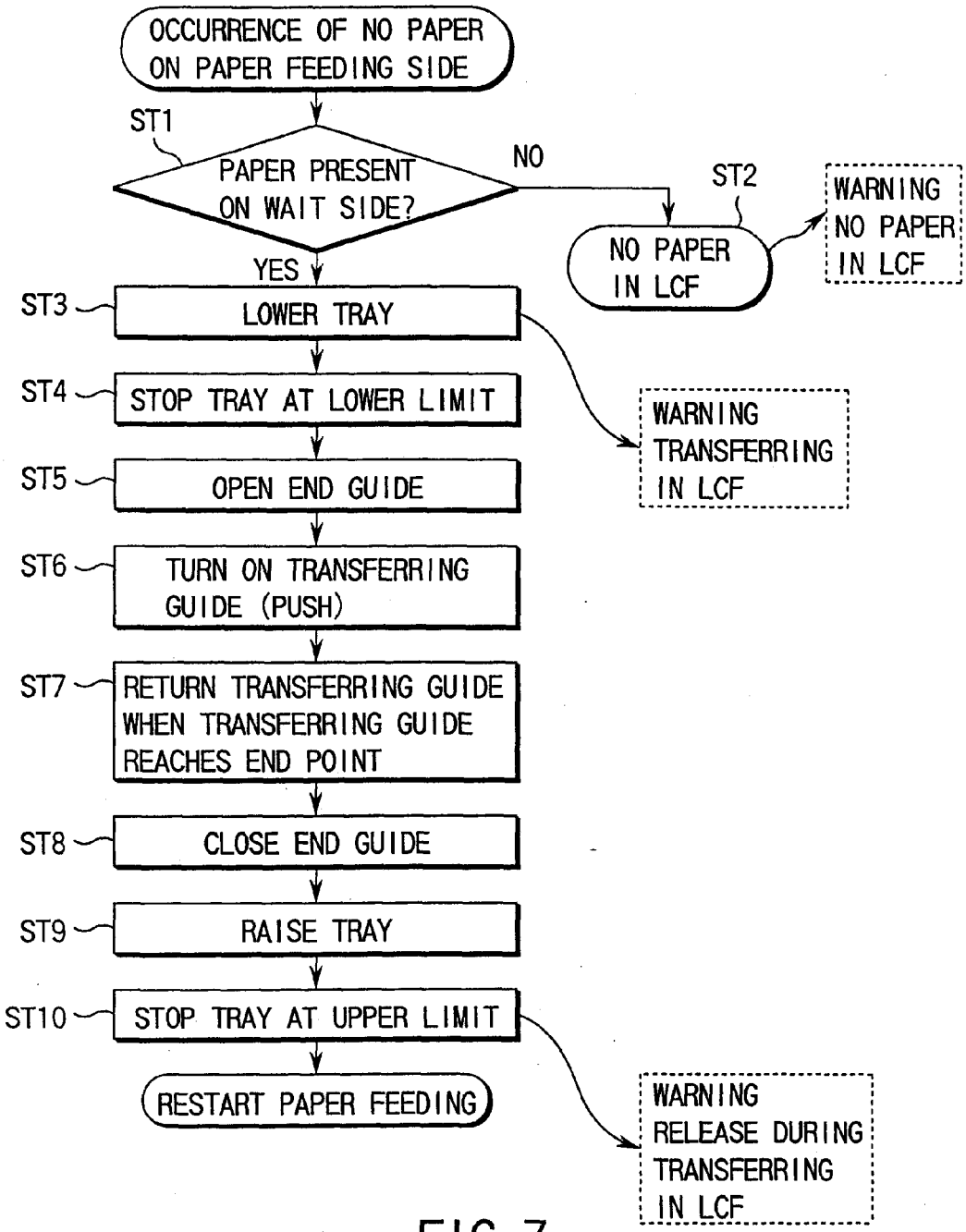
Figure 8:
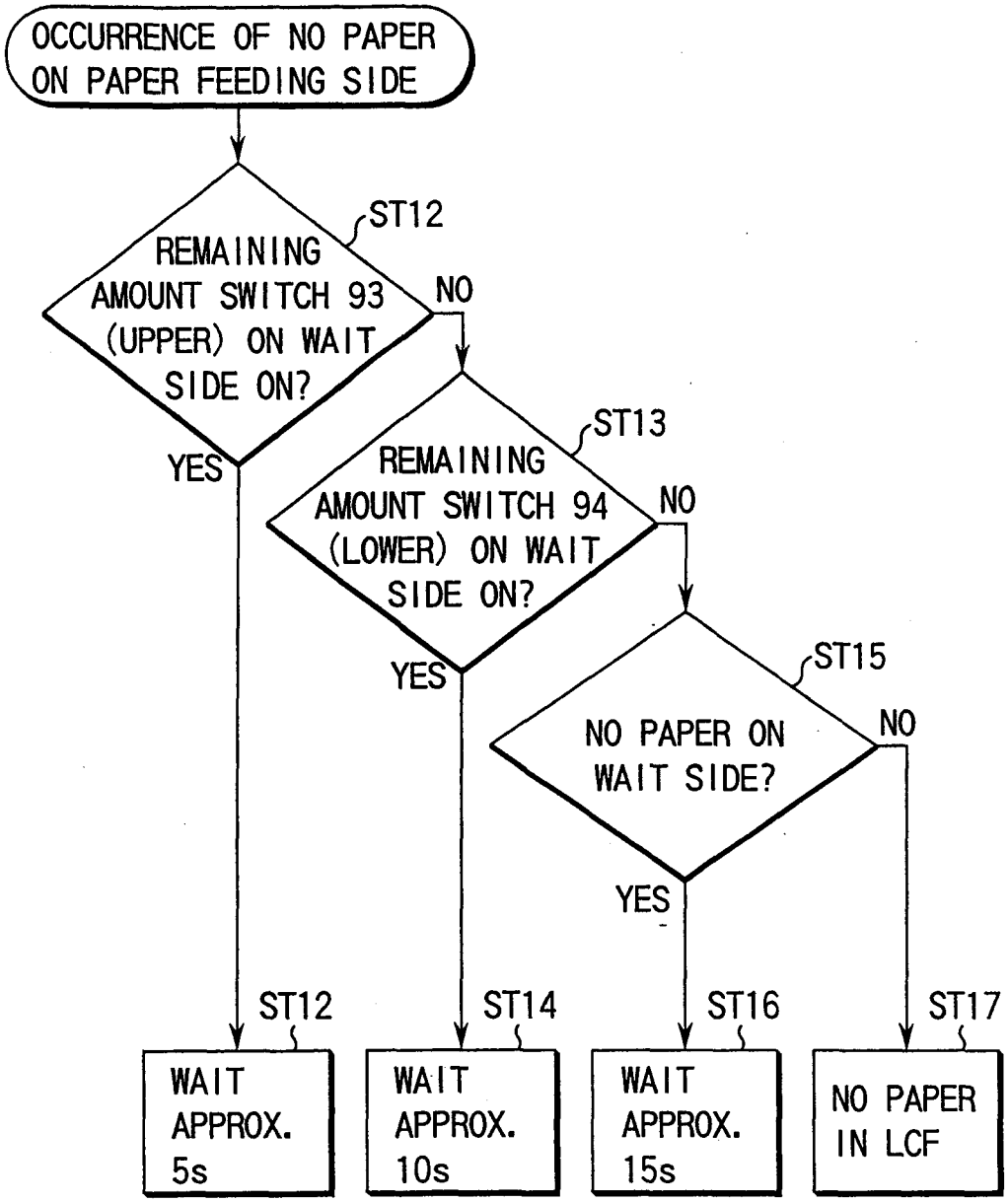
Figure 9:
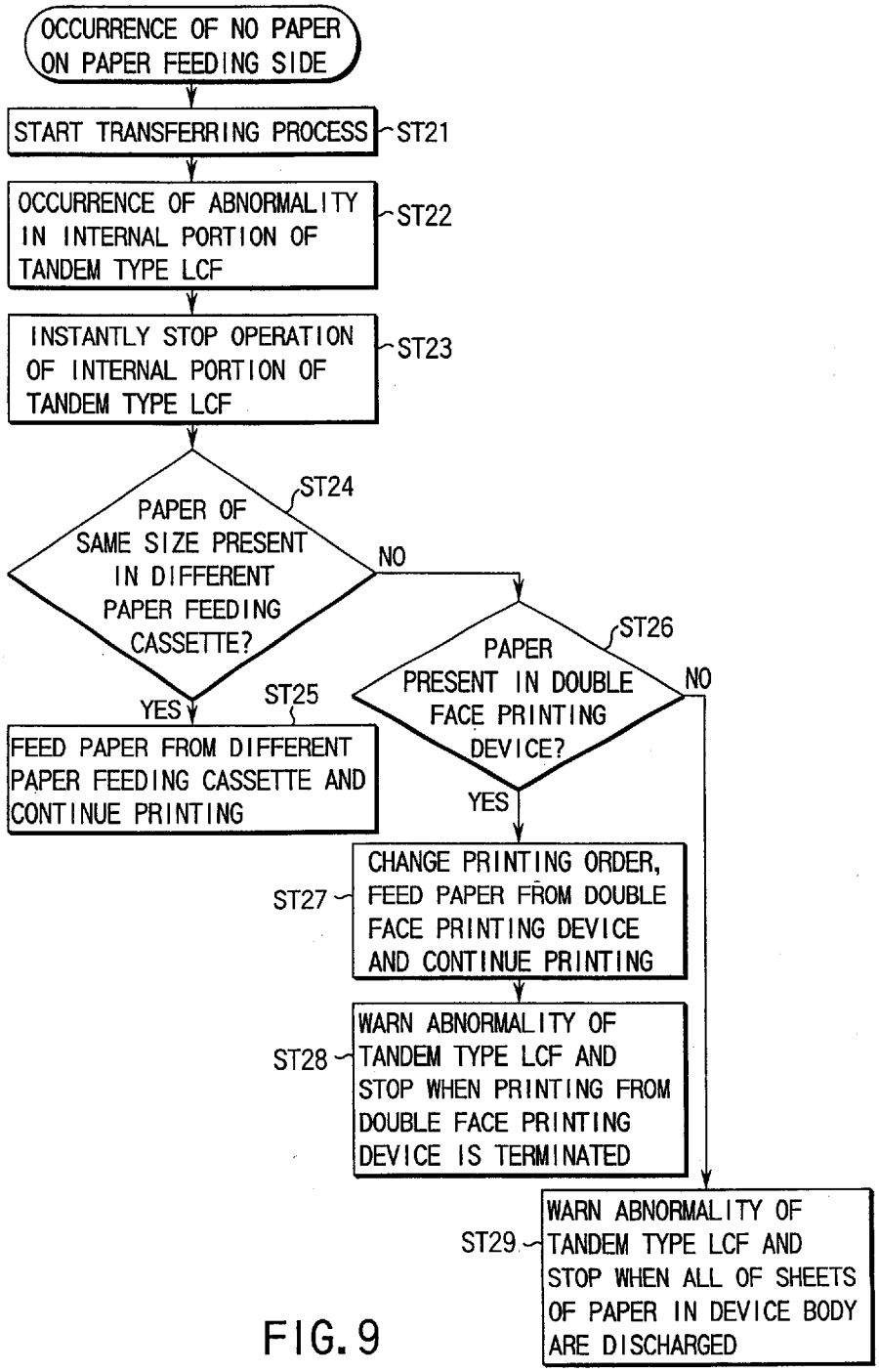
Figure 10:
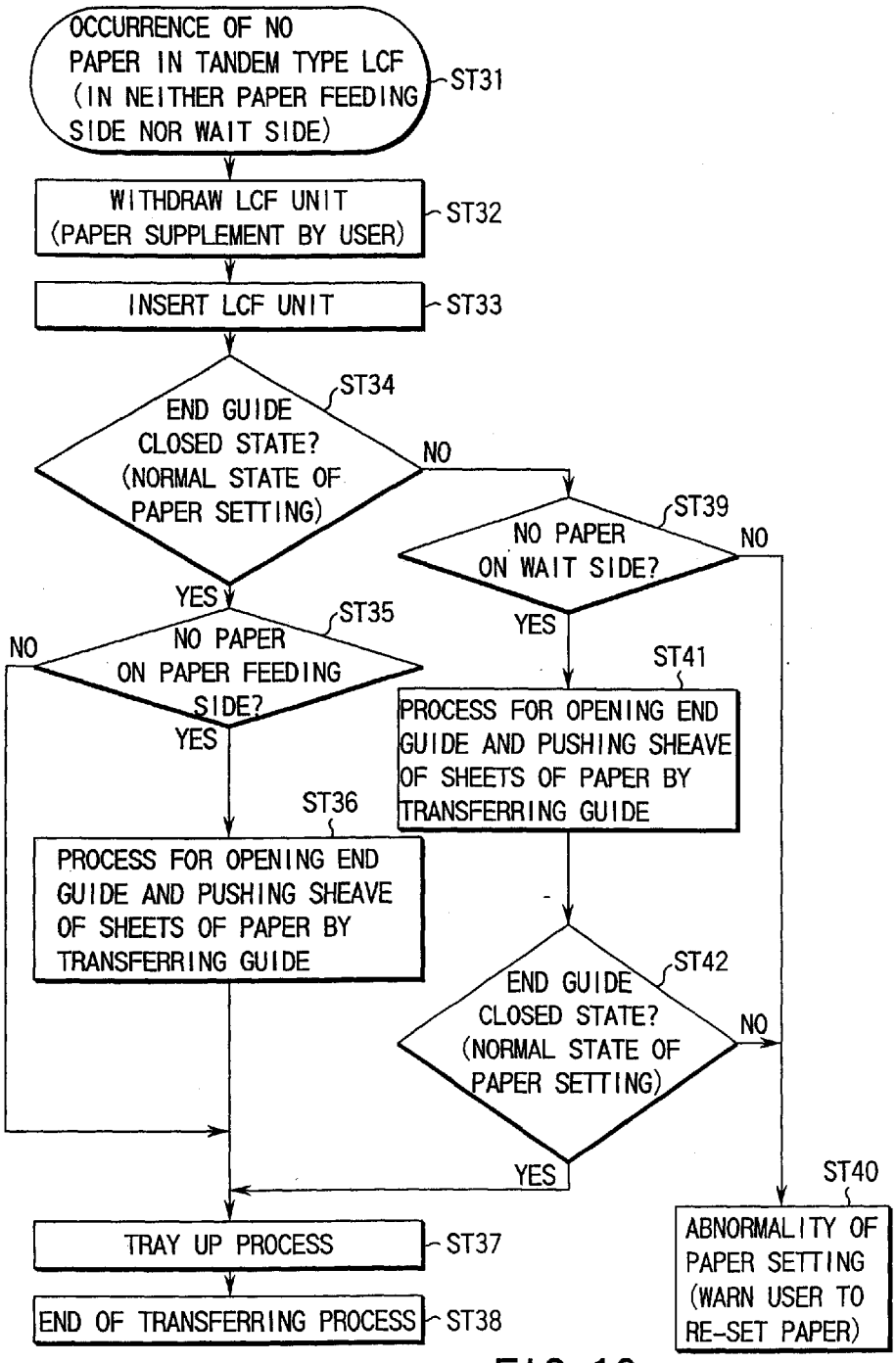
Figure 11:
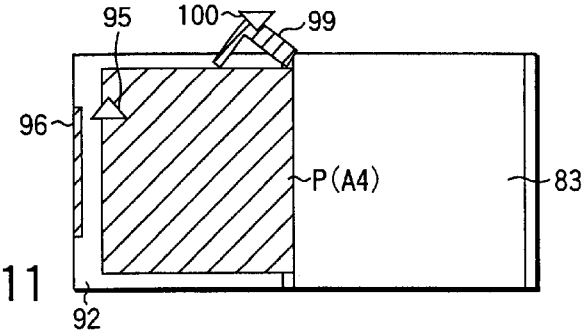
Figure 12:
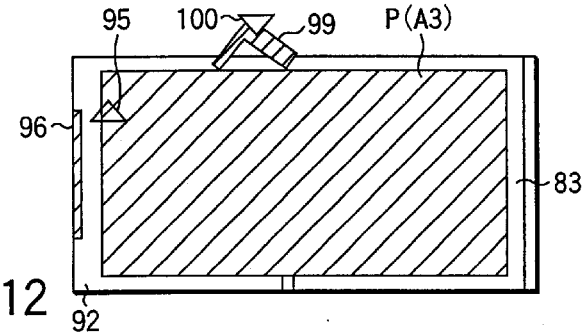
Figure 13:
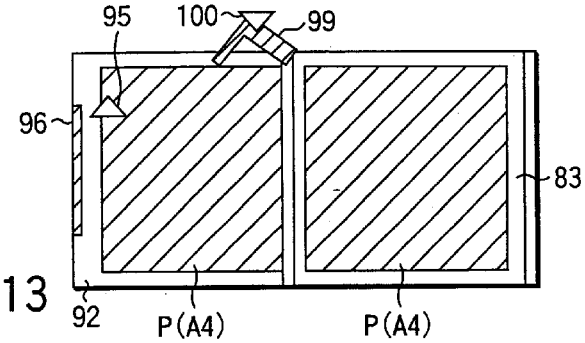
Figure 14:
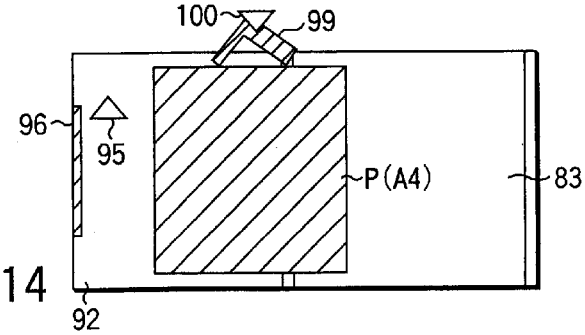

Further, it is also assumed that paper P is placed near substantially an intermediate position between the paper feeding side 80 and the wait side 81. They are the state shown in FIG. 14. In this case, it is assumed that the way of setting is improper although the size is correct and it is not the case wherein sheets of paper P are separately set on both of the paper feeding side 80 and the wait side 81. Therefore, there is a possibility that a sheave of sheets of paper P lying over the end guide 99 can be pushed towards the paper feeding side 80 by pushing by the transferring guide 96.

Therefore, if the above state is obtained in this invention, the SM-CPU 101 makes an attempt to prevent the user from re-setting paper by pushing it once by the transferring guide 96 (ST41). As a result, if the end guide switch is turned OFF, the SM-CPU 101 determines that setting of the paper P is correct (ST42), effects the tray-up process and terminates the process (ST37, 38).

If the end guide switch is kept ON (ST42) and the paper P lies over the end guide 99 even if it is pushed by the transferring guide 96 in the step ST41, the SM-CPU 101 determines that setting of the paper is abnormal (ST40).

As described above, it determines the ON/OFF state of the no-paper-on-the-wait-side switch 95 of the wait side 81 together with the open/closed state of the end guide 99 at the time of insertion of a cassette and effects the transferring process depending on a case.

That is,

1. If the LCF 52 is inserted, it checks the end guide 99.
2. If the end guide 99 is closed and paper P is present on the paper feeding side 80, it effects the normal tray-up process.
3. If the end guide 99 is closed and no paper P is present on the paper feeding side 80, it effects the tray-up process after opening the end guide 99 and effecting the control operation for pushing the paper P by the transferring guide 96.
4. If no paper P is present on the wait side 81 even if the end guide 99 is open, it effects the control operation for pushing the paper P by the transferring guide 96, then checks the open/closed state of the end guide 99 again and effects the tray-up process after it is closed.

Thus, it is possible for the user to omit time and labor for re-setting paper P and the transferring process can be safely effected in internal portion of the LCF 52.

As a result, if setting of paper P of the tandem type LCF 52 cannot be correctly effected, an attempt is made to prevent the user from re-setting paper by causing the transferring guide 96 to effect the process for pushing a sheave of sheets of paper towards the paper feeding side 80 in a case where it is predicted that it is structurally safe based on information of the end guide switch 100 and the no-paper-on-the-wait-side switch 95.

Thus, useless time and labor of the user can be alleviated and the reliability as a device can be enhanced by effecting the transferring process which is structurally safe.

What is claimed is:

1. A feed paper apparatus characterized by comprising:

first and second receiving sections for receiving sheaves of sheets of paper of the same size;

paper feeding means for feeding paper received in said first receiving section for each sheet;

transferring means for transferring a sheave of sheets of paper received in said second receiving section to said first receiving section in a lump;

first detecting means for detecting that paper received in said first receiving section is absent;

first processing means for controlling said transferring means to transfer the sheave of sheets of paper received in said second receiving section to said first receiving section in a lump when said first detecting means detects that paper received in said first receiving-section is absent;

second detecting means for detecting that a sheave of sheets of paper is received while lying over said first, second receiving sections; and second processing means for controlling said transferring means to transfer a sheave of sheets of paper received while lying over said first, second receiving sections to said first receiving section in a lump when said second detecting means detects that the sheave of sheets of paper is received while lying over said first, second receiving sections.

2. A feed paper apparatus characterized by comprising:

first and second receiving sections for receiving sheaves of sheets of paper of the same size;

paper feeding means for feeding paper received in said first receiving section for each sheet;

transferring means for transferring a sheave of sheets of paper received in said second receiving section to said first receiving section in a lump;

first detecting means for detecting that paper received in said first receiving section is absent;

first processing means for controlling said transferring means to transfer the sheave of sheets of paper received in said second receiving section to said first receiving section in a lump when said first detecting means detects that paper received in said first receiving section is absent;

second detecting means disposed on an end portion opposite to said first receiving section, for detecting the presence/absence of a sheave of sheets of paper received in said second receiving section;

third detecting means for detecting the presence/absence of a sheave of sheets of paper in an intermediate portion between said first and second receiving sections; and second processing means for controlling said transferring means to transfer a sheave of sheets of paper received in the intermediate portion between said first and second receiving sections to said first receiving section in a lump when said second detecting means detects the absence of a sheave of sheets of paper in said second receiving section and said third detecting means detects the presence of a sheave of sheets of paper in the intermediate portion between said first and second receiving sections.

3. The feed paper apparatus according to claim 2, characterized in that said second processing means includes determining means for determining abnormality when the presence of a sheave of sheets of paper in the intermediate portion between said first and second receiving sections is detected by said third detecting means after the process by said second processing means.

4. In an image forming apparatus comprising:

supply means for supplying an image;

a feed paper apparatus for feeding an image forming medium; and image forming means for forming an image supplied from said supply means on an image forming medium fed by said feed paper apparatus;

the image forming apparatus is characterized in that said feed paper apparatus comprises:

first and second receiving sections for receiving sheaves of sheets of paper of the same size;

paper feeding means for feeding paper received in said first receiving section for each sheet;

transferring means for transferring a sheave of sheets of paper received in said second receiving section to said first receiving section in a lump;

first detecting means for detecting that paper received in said first receiving section is absent;

first processing means for controlling said transferring means to transfer the sheave of sheets of paper received in said second receiving section to said first receiving section in a lump when said first detecting means detects that paper received in said first receiving section is absent;

second detecting means for detecting that a sheave of sheets of paper is received while lying over said first, second receiving sections; and second processing means for controlling said transferring means to transfer a sheave of sheets of paper received while lying over said first, second receiving sections to said first receiving section in a lump when said second detecting means detects that the sheave of sheets of paper is received while lying over said first, second receiving sections.

5. In an image forming apparatus comprising:

supply means for supplying an image;

a feed paper apparatus for feeding an image forming medium; and image forming means for forming an image supplied from said supply means on an image forming medium fed by said feed paper apparatus;

the image forming apparatus is characterized in that said feed paper apparatus comprises:

first and second receiving sections for receiving sheaves of sheets of paper of the same size;

paper feeding means for feeding paper received in said first receiving section for each sheet;

transferring means for transferring a sheave of sheets of paper received in said second receiving section to said first receiving section in a lump;

first detecting means for detecting that paper received in said first receiving section is absent;

first processing means for controlling said transferring means to transfer the sheave of sheets of paper received in said second receiving section to said first receiving section in a lump when said first detecting means detects that paper received in said first receiving section is absent;

second detecting means disposed on an end portion opposite to said first receiving section, for detecting the presence/absence of a sheave of sheets of paper received in said second receiving section;

third detecting means for detecting the presence/absence of a sheave of sheets of paper in an intermediate portion between said first and second receiving sections; and second processing means for controlling said transferring means to transfer a sheave of sheets of paper received in the intermediate portion between said first and second receiving sections to said first receiving section in a lump when said second detecting means detects the absence of a sheave of sheets of paper in said second receiving section and said third detecting means detects the presence of a sheave of sheets of paper in the intermediate portion between said first and second receiving sections.

6. The image forming apparatus according to claim 5, characterized in that said second processing means includes determining means for determining abnormality when the presence of a sheave of sheets of paper in the intermediate portion between said first and second receiving sections is detected by said third detecting means after the process by said second processing means.

* * * * *

UNITED STATES PATENT AND TRADEMARK OFFICE

CERTIFICATE OF CORRECTION

PATENT NO. : 6,332,609 B1
DATED : December 25, 2001
INVENTOR(S) : Masaya Arakawa It is certified that error appears in the above-identified patent and that said Letters Patent is hereby corrected as shown below:

Drawings,
Please replace the drawings with the English Translation of the drawings, 9 sheets of Drawings, Figures 1-14.

Signed and Sealed this

Seventeenth Day of June, 2003

JAMES E. ROGAN
*Director of the United States Patent and Trademark Office*